US005975592A

United States Patent [19]

Lin

[11] Patent Number: 5,975,592

[45] Date of Patent: Nov. 2, 1999

[54] MULTI-COMPONENT LOCK ASSEMBLY

[76] Inventor: Joe Lin, 4114 Kingcotton La., Missouri City, Tex. 77459

[21] Appl. No.: 09/114,108

[22] Filed: Jul. 11, 1998

[51] Int. Cl.[6] ..... E05C 1/06

[52] U.S. Cl. ..... 292/37; 292/32; 292/159; 292/169

[58] Field of Search ..... 292/37, 159, 169, 292/165, 170, 169.19, 140, 34

[56] References Cited

U.S. PATENT DOCUMENTS

| | | | |
|---|---|---|---|
| 225,558 | 3/1880 | Brooks | 292/DIG. 37 |
| 406,903 | 7/1889 | Hebert . | |
| 478,556 | 7/1892 | Bettmann, Jr. | 292/170 |
| 1,270,288 | 6/1918 | Gruber | 292/170 |
| 1,413,979 | 4/1922 | Freund | 292/170 |
| 1,956,098 | 4/1934 | Jacobson | 292/170 |
| 2,036,154 | 3/1936 | Littledale | 292/170 |
| 2,690,144 | 9/1954 | Ellis et al. | 292/37 |
| 3,545,799 | 12/1970 | Gertsfeld | 292/34 |
| 3,596,952 | 8/1971 | Hinkle | 292/DIG. 37 |
| 4,094,540 | 6/1978 | Roig | 292/214 |
| 4,765,663 | 8/1988 | Raymond et al. | 292/169.13 |
| 4,875,727 | 10/1989 | Kautt | 292/337 |
| 5,028,082 | 7/1991 | Kronbetter | 292/128 |
| 5,542,720 | 8/1996 | Fleming | 292/32 |
| 5,579,558 | 12/1996 | Newman, Jr. et al. | 16/115 |

*Primary Examiner*—Steven Meyers
*Assistant Examiner*—Teri Pham
*Attorney, Agent, or Firm*—John R Casperson; Maryam Bani-Jamali

[57] ABSTRACT

A lock assembly comprising a housing, a control mechanism, one pin or two pins supported by the housing for shifting movement of the pin or of the two pins in a direction transverse to direction of movement of the control mechanism between a locked position and an unlocked position and a spring for each pin for enhancing the shifting movement of the corresponding pin toward the unlocked position and for automatically returning the corresponding pin toward the locked position upon release of the control mechanism. When the control mechanism is pushed manually, the pressure which is exerted upon pushing the control means compresses the spring around the pin or two pins which each shifts in a direction transverse to direction of movement of the control mechanism between the locked position and the unlocked position. Meanwhile, shifting of the pin or of the two pins permits the sliding of a cut-out section of the control mechanism until the pin or pins strike against the cut-out sections of the control mechanism. As soon as the movement is stopped, the pin or two pins which are acted on by the spring assume a position which assures locking. As soon as the control mechanism is released, the pin or two pins immediately and automatically return to the locked position again.

15 Claims, 4 Drawing Sheets

MULTI-COMPONENT LOCK ASSEMBLY

BACKGROUND OF THE INVENTION

1. Field of the Invention

This invention relates to an improved multi-component lock assembly designed for secure locking of a first sliding member positioned between a pair of second sliding members. Another version of the invention relates to an improved multi-component lock assembly designed for secure locking of a second sliding member positioned inside a first sliding member.

2. Description of the Prior Art

A wide variety of lock assemblies have been designed to lock and unlock relatively slidable members. Some lock assemblies are mainly related to and basically limited to sliding doors. Two such inventions are demonstrated in the following patents:

Fleming, U.S. Pat. No. 5,542,720, issued on Aug. 6, 1996, patents a multi-point lock assembly for a sliding door. The multi-point lock assembly comprises a plurality of latch cartridges mounted at vertically spaced positions along a free side edge of a sliding door. The latch cartridges each include a latch port and can be moved together to engage headed latch pins mounted on an adjacent door jamb. A trigger assembly retains the latch cartridges in an unlatched positioned until the door is closed. Then, the trigger assembly releases the latch cartridges for spring-loaded movement to a latched position to engage the latch pins.

Raymond et al., U.S. Pat. No. 4,765,663, issued on Aug. 23, 1988, patent a spring-loaded dead bolt assembly. A lock assembly is provided that comprises a spring-loaded dead bolt and a spring-loaded plunger that are intercoupled to one another.

Some previously and presently existing lock assemblies have had various applications in different areas. As examples, several patents that have been issued in the past few decades and are focused on numerous applications of lock assemblies follow:

Kronbetter, U.S. Pat. No. 5,028,082, registered on Jul. 2, 1991, discusses a latching mechanism for opposed sliding members. The latching mechanism has a first and second latch subassembly that are adapted to be secured to a first and second sliding member, respectively. The first latch subassembly has a pivotally mounted first release lever and presents a catch block that has a cam portion and a locking portion. The second latch subassembly similarly has a pivotally mounted second release lever and a latch arm to engage the cam portion of the first latch assembly when the sliding members are closing and to engage the locking portion of the first latch assembly.

Kautt, U.S. Pat. No. 4,875,727, issued on Oct. 24, 1989, patents a covering element for multi-lock fitting fastened to a door, window or the like. The covering element consists of a rectangular-sectioned tubular member of which one of the minor sides is coplanar with the lateral edge of the jamb of the movable or fixed frame of the door, window or the like and one of the major sides of the tubular member is provided with apertures covering the plurality of lock plate blocks and comprising detent-positioning means interposed between the lock plate blocks and the inner surface of the movable or fixed frame.

Roig, U.S. Pat. No. 4,094,540, issued on Jun. 13, 1978, patents a closure device for locking a movable element with respect to another element. The closure device comprises a male member, including a flat plate of substantially constant thickness, and a female member, including a portion provided with an elongate cutout having a width slightly larger than the thickness of the flat plate. The cutout-bearing portion is pivotable in one direction upon introduction of the flat plate into the cutout, and pivots in the other direction to wedge the plate and prevent withdrawal thereof. Using resilient means, the cutout bearing portion is urged toward its wedging position. Using handle means, cutout-bearing portion is returned to its unwedged position to permit withdrawal of the plate.

The above-listed patents and many other similar inventions have been developed, some of which still exist in the market. The patents and innovations in the market that are related to similar lock assemblies have been oriented towards doors and windows. However, this invention strives towards additional applications as well. The following patent is provided for extending the reach of a tool such as a paint roller or the like:

Newman, Jr. et al., U.S. Pat. No. 5,579,558, registered on Dec. 3, 1996, discuss an extension handle with a locking mechanism and a first end presenting an axial opening. The locking mechanism comprises a housing supported on the extension handle at the first end, a pin supported by the housing for shifting movement in a direction transverse to the length of the extension handle between a locked position extending into the opening and an unlocked position withdrawn from the opening, a biasing member for biasing the pin toward the locked position and a release button for releasing the biasing member and shifting the pin to the unlocked position.

Due to the broad range of coverage of the present application, the areas of application of the present invention may range from usage as a lock assembly for doors and windows, to usage as a lock assembly for tool handles, for stilts, for benches and for leg extensions, to name a few.

Despite limitations in scope of application, some previously and presently existing lock assemblies have performed in a satisfactory manner. Meanwhile, there has existed a continuing desire and need for further improvements in high security lock assemblies designed to safely and positively lock a door, window, tool, stilt, bench and other devices against unexpected unlocking. Toward this end, so-called multi-point lock assemblies have been proposed. In addition, there has been a desire for lock assemblies that are designed for independent actuation (e.g. with the push of a button and without using any handles). However, when using independent actuation, in some instances, there have been the unfortunate results that some of the lock members are frequently left disengaged due to human forgetfulness and/or neglect. Disadvantages of lock assemblies with independent actuation over lock assemblies with dependent actuation (i.e. concurrent actuation from a single actuator handle or lever) are relative difficulty in assembling and in installing in a cost effective manner.

SUMMARY OF THE INVENTION

A primary object of the invention is to devise a lock assembly that provides a secure, stable and safe locking system for doors, windows, stilts, benches and other similar devices consisting of a first sliding member within a pair of second sliding members.

Another object of this invention is to devise a lock assembly adapted for use with any of a plurality of different tool constructions having various configurations and designed for secure locking of a second sliding member positioned inside a first sliding member.

An additional object of this invention is to devise a lock assembly which simplifies attachment and removal of an extension.

Another object of this invention is to devise a lock assembly which can be easily unlocked in one continuous operation with only one hand and, preferably, one finger.

A final object of this invention is to devise a lock assembly which automatically locks when a control means of the lock assembly is released and is, thereafter, held securely in locked position until the control means is pushed again.

Additional objects and advantages of the invention will be set forth in part in a detailed description which follows, and in part will be obvious from the description, or may be learned by practice of the invention.

The present invention provides a lock assembly comprising a housing, a control means, one pin or two pins supported by the housing for shifting movement of the pin or of the two pins moving from a locked position to an unlocked position in a direction transverse to direction of movement of the control means between a locked position and an unlocked position and a spring for each pin for automatically returning the pin toward the locked position upon release of the control means. The control means is pushed for starting and enhancing the shifting movement of each pin toward the unlocked position.

In cases where two pins are used, the lock assembly comprises the housing consisting of a first pair of opposite sides with a first pair of openings that lead to a first channel in the housing, a second pair of opposite sides with a second pair of openings that lead to a second channel in the housing that intersects and is transversal to the first channel and a third pair of opposite sides including a back side, an attaching means that connects the housing to a first sliding member, the control means comprising a front section, a back section, a top section, a bottom section, a pair of opposite side sections and a cut-out section on the front section, on the back section and on each opposite side section (whereby a primary channel extends between the front section and the back section and whereby a secondary channel extends between the pair of opposite side sections) and being shifted by a user from the locked position to the unlocked position (and automatically returning to the locked position upon being released) through the first pair of openings, the pair of pins supported by the housing and automatically shifting throughout the second pair of openings in a direction transverse to direction of shift of the control means and between the locked position and the unlocked position (and automatically shifting back to the locked position upon being released) and one spring for each pin for enhancing the shifting movement of the pin toward the locked position, such that when the control means moves through the first channel of the housing from the unlocked position to the locked position and the lock assembly is locked, the pair of pins automatically shift out via the second channel of the housing through the second pair of openings and such that when the control means is shifted through the first channel from the locked position to the unlocked position and the lock assembly is unlocked, the pair of pins automatically shift inwards via the second channel through the second pair of openings and the first sliding member slides along a pair of second sliding members.

In housings where only one pin is used, the first opening leads to a first channel and the second opening leads to a second channel in the housing. The first channel and the second channel intersect in the housing. The first channel extends across the housing in one direction, while the second channel extends across the housing in a transverse direction. The control means passes through the first channel and the pin passes through the second channel. As a result, the pin can be forced to move through the second channel and the control means can be pushed throughout the first channel.

When the control means is pushed manually, the pressure which is exerted upon pushing the control means compresses the spring around the pin or two pins which each shifts in a direction transverse to direction of movement of the control means between the locked position and the unlocked position. Meanwhile, shifting of the pin or of the two pins permits the sliding of the cut-out section of the control means until the pin or pins strike against the cut-out sections of the control means. As soon as the movement is stopped, the pin or two pins which are acted on by the spring assume a position which assures locking. The spring for each pin pushes behind the corresponding disc, causing the corresponding pin to return to the locked position again and remain in the locked position thereafter until the control means is pushed. As soon as the control means is released, the pin or two pins immediately and automatically return to the locked position. The pin or two pins remain in the locked position until the control means is pushed again.

It is to be understood that the descriptions of this invention are exemplary and explanatory, but are not restrictive, of the invention. Other objects and advantages of this invention will become apparent from the following specification and from any accompanying charts, tables, examples and drawings.

BRIEF DESCRIPTION OF CHARTS, TABLES, EXAMPLES AND DRAWINGS

Any accompanying charts, tables, examples and drawings which are incorporated in and constitute a part of this specification, illustrate examples of preferred embodiments of the invention and, along with the description, serve to explain the principles of the invention.

DETAILED DESCRIPTION OF THE PREFERRED EMBODIMENT

Preferred embodiments of the present invention are illustrated in any charts, tables, examples and drawings that are included.

Figure 2A:
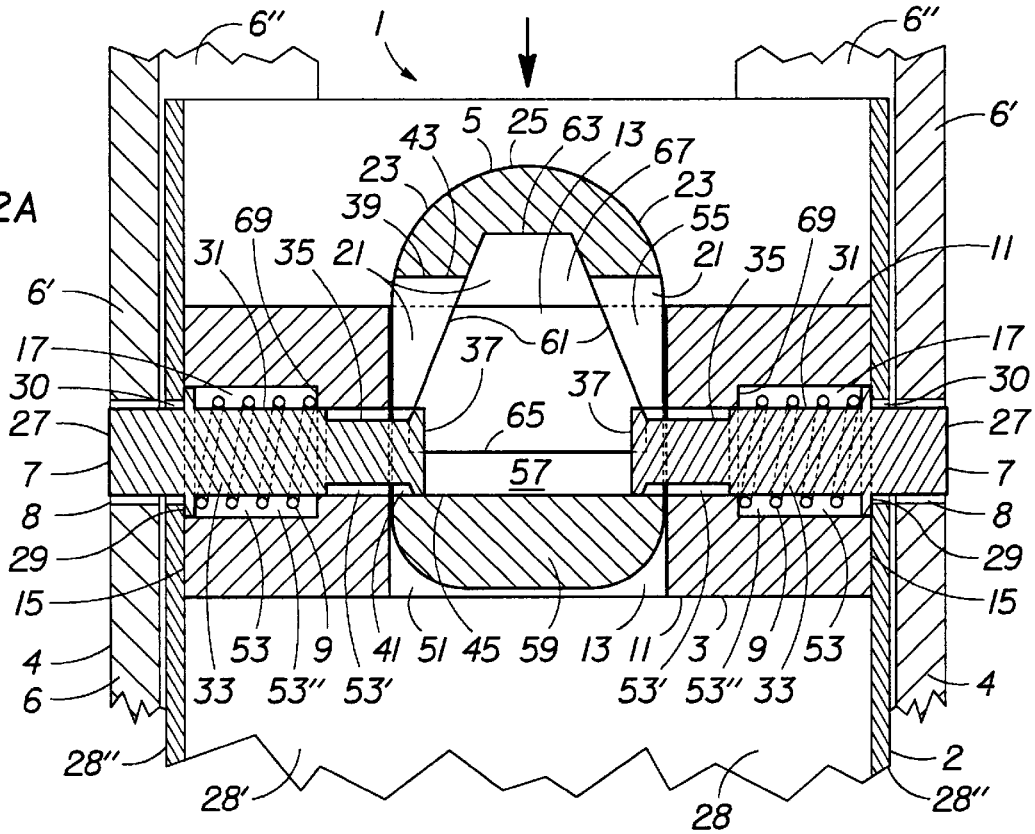
FIG. 2A shows a cross-sectional view of the lock assembly of FIG. 1A, when the lock assembly is in the locked position, with the lock assembly being attached to a first sliding member and to a U-channel shaped pair of second sliding member.
Figure 4:
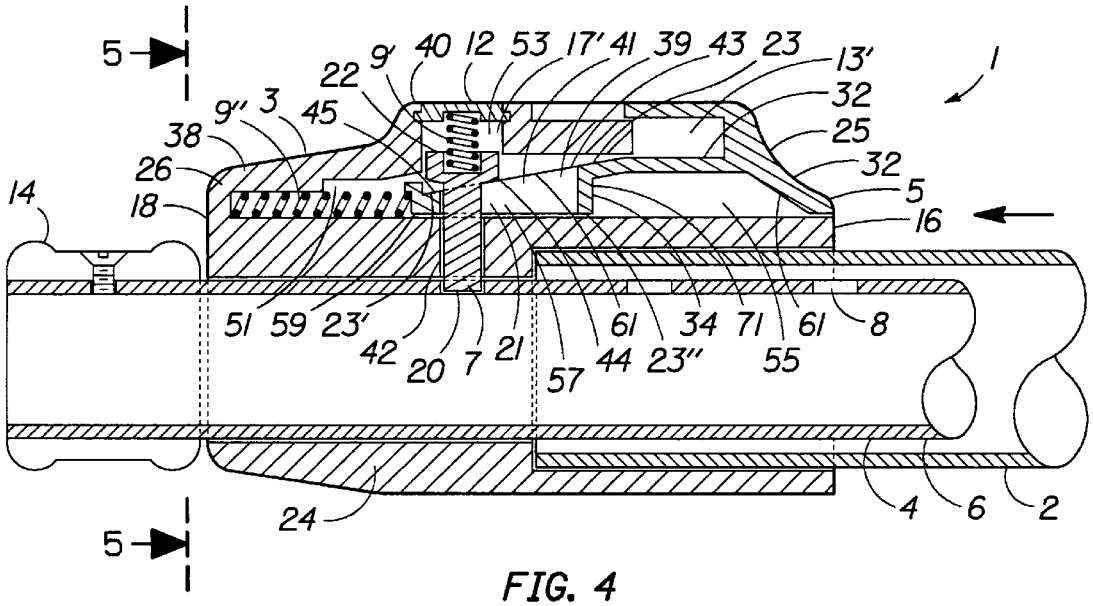
FIG. 4 shows a side sectional view of an application of the lock assembly of FIG. 3 to an extension.
Figure 5:
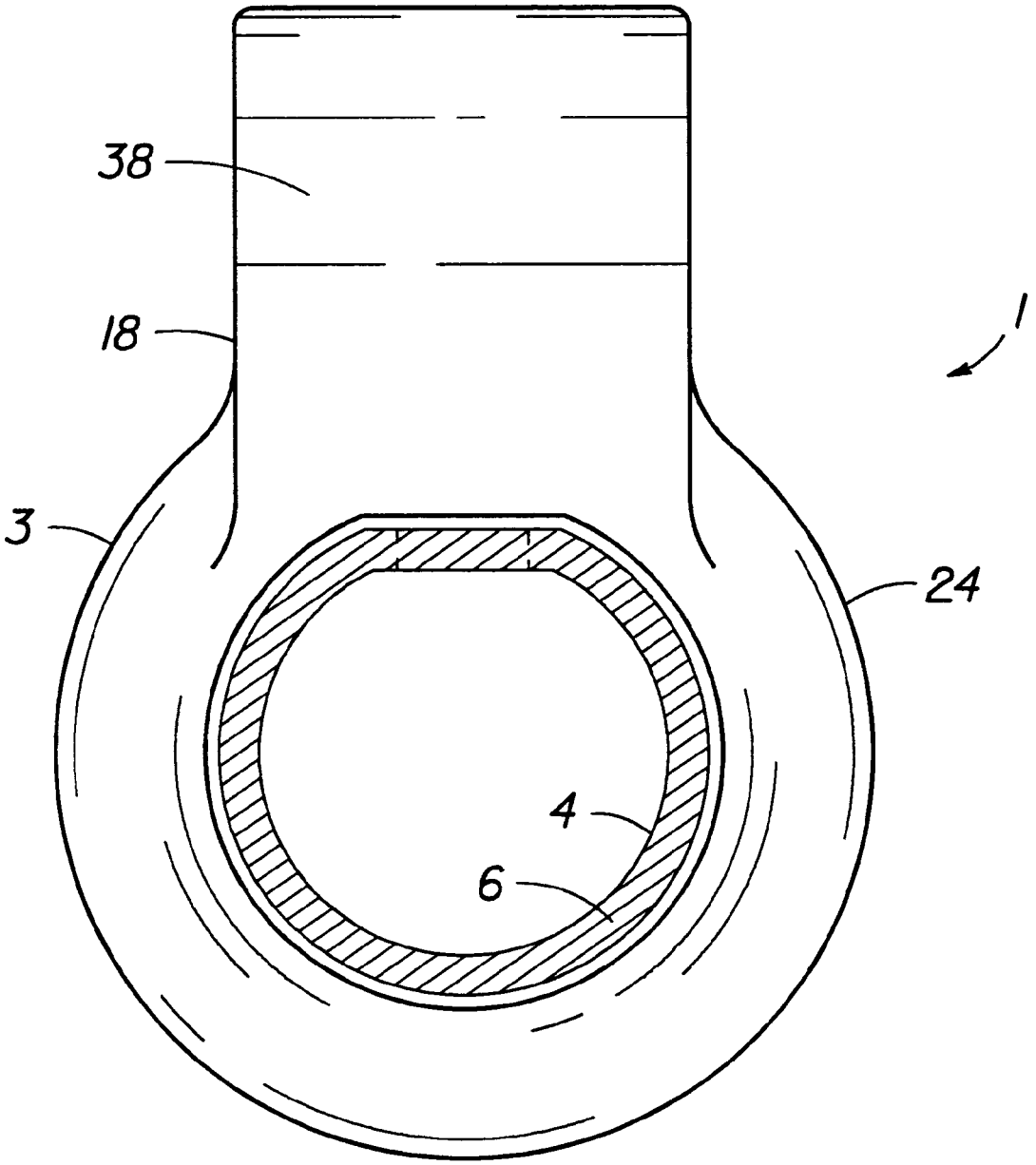
FIG. 5 shows an end view of the lock assembly of FIG. 3.

The present invention provides a lock assembly 1 for high security locking of sliding doors, sliding windows, stilts, benches and other similar devices consisting of a first sliding member 2 within a pair of second sliding members 4 using two pins 7. In FIG. 2A, the lock assembly 1 is indicated in a locked position. Another version of the present invention provides a lock assembly 1 with one pin 7 used for high security locking of tools, poles and devices as shown in FIG. 4. Yet, another version of the present invention provides a lock assembly 1 with two pins 7 used for high security locking of tools, poles and devices and resembling FIG. 4 to some extent.

Figure 1A:
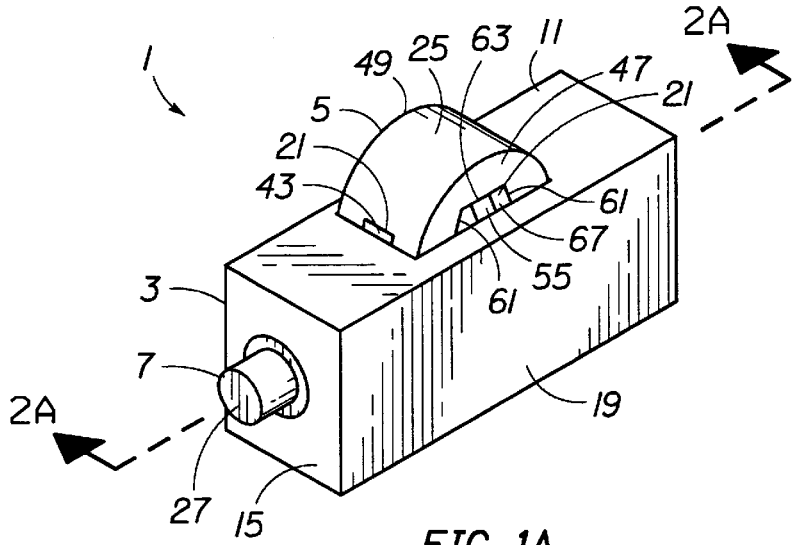
FIG. 1A shows an isometric view of a lock assembly for various applications when the lock assembly is in a locked position.
Figure 1B:
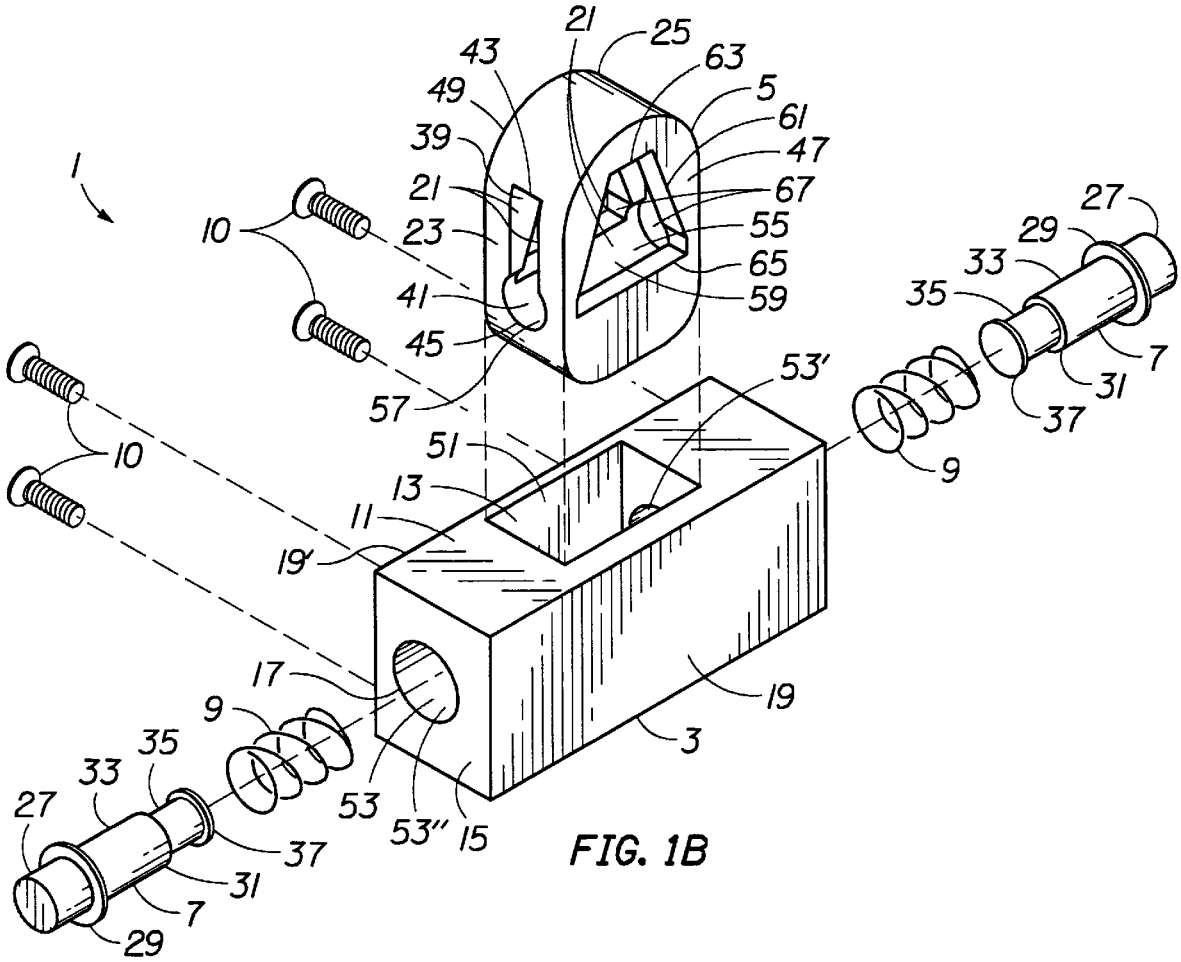
FIG. 1B shows an exploded isometric view of the lock assembly of FIG. 1A.
Figure 3:
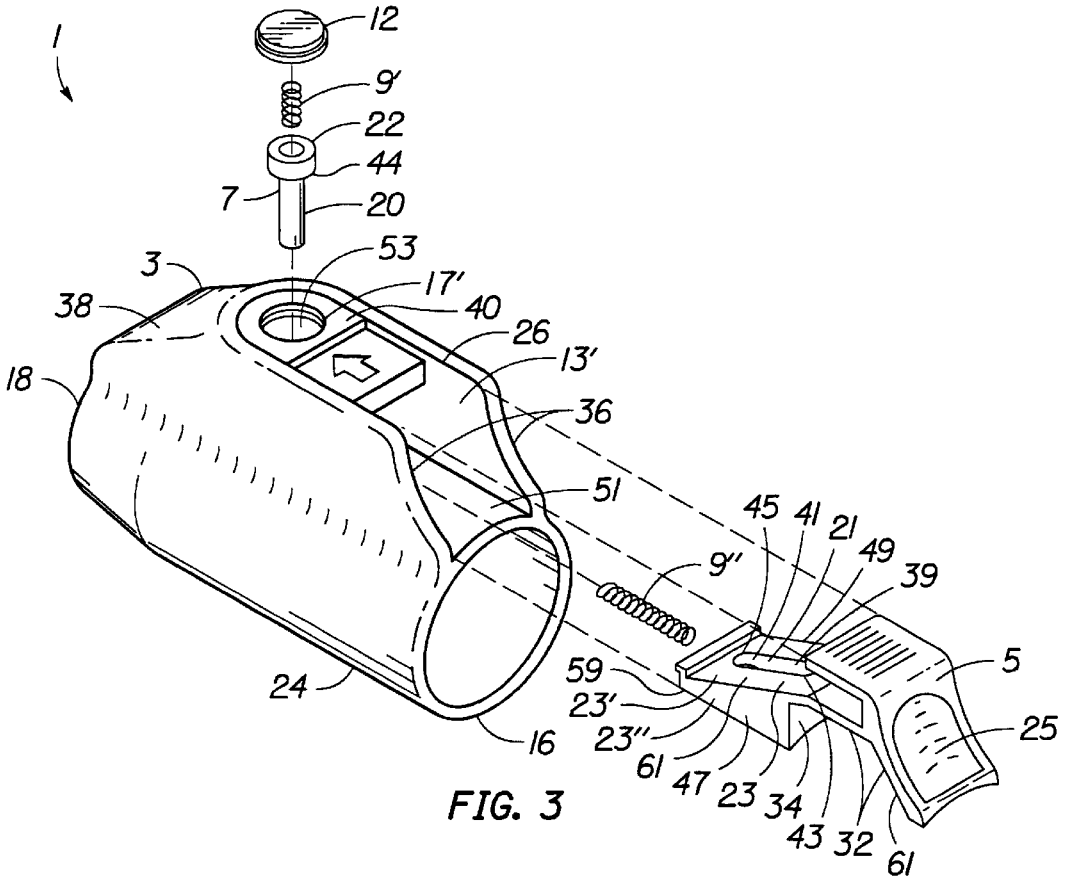
FIG. 3 shows a partially exploded view of a lock assembly having one pin.

The lock assembly 1 comprises a housing 3, a control means 5 being movably loaded onto the housing 3, either one pin 7 or two pins 7 being held by and supported by the housing 3, with the housing 3 helping to shift movement of the pin 7 or of the two pins 7 from a locked position to an unlocked position in a direction transverse to direction of movement of the control means 5 between a locked position and an unlocked position, with the control means 5 being pushed for starting and enhancing the shifting movement of each pin 7 toward the unlocked position, and a spring 9 for each pin 7, resulting in return of the corresponding pin 7 toward the locked position upon release of the control means 5 and release of the spring 9 for each pin 7 and holding the corresponding pin 7 in the locked position until the control means 5 is pushed again. The lock assemblies 1 that comprise two pins 7 (as shown in FIG. 1A and FIG. 1B) are usually used for sliding windows, sliding doors, benches, stilts and other similar devices. The lock assemblies 1 that comprise one pin 7 (as shown in FIG. 3 and FIG. 4) are usually used for tubular devices such as poles. However, lock assemblies 1 comprising two pins 7 can also be used for tubular devices such as poles.

In a preferred embodiment, in cases where two pins 7 are used (refer to FIG. 1B, FIG. 2A and FIG. 2B), the lock assembly 1 comprises the housing 3 consisting of a first pair of opposite sides 11 with a first pair of openings 13 that lead to a first channel 51 in the housing 3, a second pair of opposite sides 15 with a second pair of openings 17 that lead to a second channel 53 in the housing 3 that intersects and is transversal to the first channel 51 and a third pair of opposite sides 19 (shown in FIG. 1B), an attaching means 10 (shown in FIG. 1B) that connects the housing 3 to the first sliding member 2 (shown in FIG. 2A and FIG. 2B), the control means 5 comprising a front section 47 (shown in FIG. 1B), a back section 49 (shown in FIG. 1B), a top section 25, a bottom section 59, a pair of opposite side sections 23 and a cut-out section 21 on the front section 47 (refer to FIG. 1B), on the back section 49 (refer to FIG. 1B) and on each opposite side section 23 of the control means 5, whereby a primary channel 55 extends between the front section 47 and the back section 49 and whereby a secondary channel 57 extends between the pair of opposite side sections 23 of the control means 5 and the control means 5 being shifted by a user from the locked position to the unlocked position (and automatically returning to the locked position upon being released) through the first pair of openings 13, a pair of pins 7 supported by the housing 3 and automatically shifting throughout the second pair of openings 17 in a direction transverse to direction of shift of the control means 5 and between the locked position and the unlocked position (and automatically shifting back to the locked position upon being released) and one spring 9 for each pin 7 for enhancing the shifting movement of the pin 7 toward the locked position, such that when the control means 5 moves through the first channel 51 of the housing 3 from the unlocked position to the locked position and the lock assembly 1 is locked, the pair of pins 7 automatically shift out via the second channel 53 of the housing 3 through the second pair of openings 17 and such that when the control means 5 is shifted through the first channel 51 from the locked position to the unlocked position and the lock assembly 1 is unlocked, the pair of pins 7 automatically shift inwards via the second channel 53 through the second pair of openings 17.

Figure 2B:
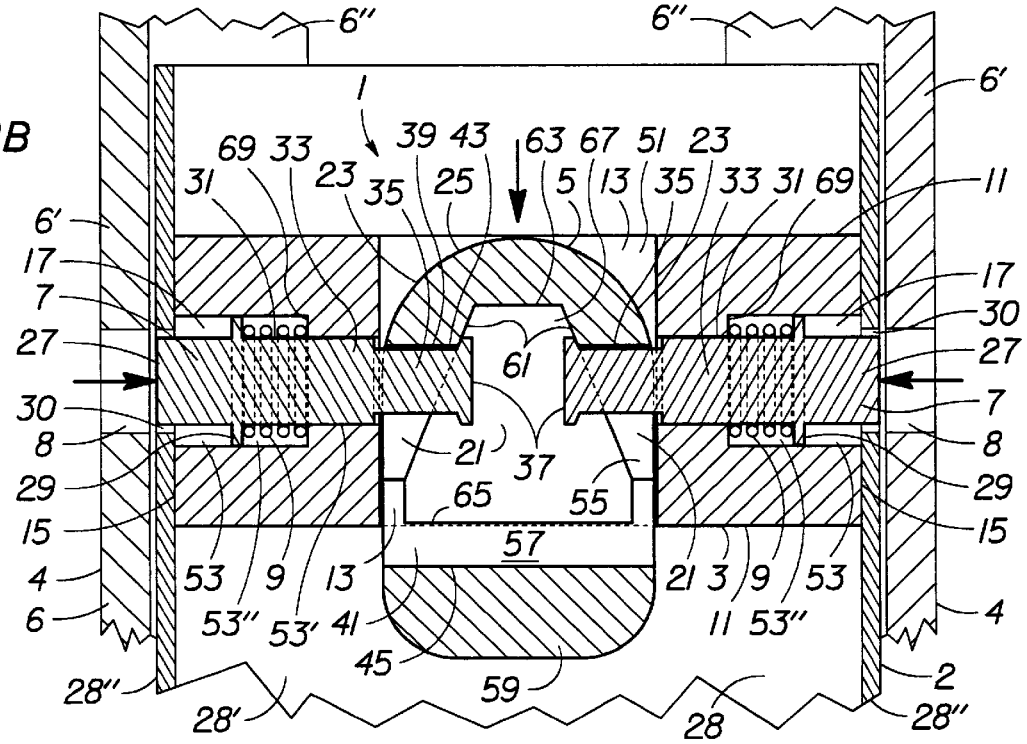
FIG. 2B shows a cross-sectional view of the lock assembly of FIG. 2A, when the lock assembly is an unlocked position.

As shown in FIG. 2A and FIG. 2B, in a preferred embodiment, the first sliding member 2 that is used for locking of sliding doors, sliding windows, stilts, benches and other similar devices in the lock assembly 1 is U-shaped. Therefore, when the pair of pins 7 shift inwards via the second channel 53 through the second pair of openings 17, the first sliding member 2 slides along the pair of second sliding members 4 (with a minute space existing between the first sliding member 2 and the pair of second sliding members 4) while the housing 3 is tightly embraced by the first sliding member 2. In another embodiment, the first sliding member 2 consists of a flat sheet and, therefore, when the pair of pins 7 shift inwards via the second channel 53 through the second pair of openings 17 of the second pair of opposite sides 15 of the housing 3, each opposite side 15 of the second pair of opposite sides 15 of the housing 3 slides along the corresponding second sliding member 4 (with a minute space existing between each opposite side 15 of the housing 3 and each corresponding second sliding member 4) while the housing 3 is tightly attached to the first sliding member 2 (i.e. no section of the first sliding member 2 extends between the pair of second sliding members 4 and the second pair of opposite sides 15 of the housing 3).

In a preferred embodiment, the housing 3 is supported stably by the first sliding member 2 and the pair of second sliding members 4. The first sliding member 2 has a number of walls 28. In a preferred embodiment, the first sliding member 2 is semi-rectangular or U-shaped, i.e. the first sliding member 2 has three walls 28 (as shown in FIG. 2A and FIG. 2B). The three walls 28 of the first sliding member 2 consist of an end wall 28' and two side walls 28". Each side wall 28" of the first sliding member 2 extends along the corresponding side 15 of the second pair of opposite sides 15 of the housing 3, such that the back side 19' (shown in FIG. 1B) and the second pair of opposite sides 15 of the housing 3 are openly embraced by the walls 28 of the first sliding member 2. Each side wall 28" of the first sliding member 2 has a number of transverse holes 30, with each transverse hole 30 extending through the corresponding side wall 28" and with each pair of transverse holes 30 being preferably directly opposite to each other (i.e. on opposite sides of the housing 3 of the lock assembly 1). The pair of second sliding members 4 have a number of walls 6. A preferred version of the pair of second sliding members 4 is shown in FIG. 2A and FIG. 2B and is semi-rectangular or U-shaped, with its number of walls 6 consisting of two side walls 6" (not shown) and an end wall 6'. The end wall 6' of each second sliding member 4 includes transverse holes 8, with each transverse hole 8 extending through the corresponding end wall 6'. Transverse holes 8 extend through the pair of second sliding members 4, with each corresponding pair of transverse holes 8 being preferably directly opposite to each other (i.e. on opposite sides of the housing 3 of the lock assembly 1). The pair of pins 7 of the lock assembly 1 pass through and are locked in the corresponding pair of transverse holes 8 that extend through the corresponding end wall 6' of the pair of second sliding members 4, with the pair of transverse holes 8 being directly opposite to each other. The transverse holes 8 of the pair of second sliding members 4 and the number of transverse holes 30 of the first sliding member 2 are spaced circumferentially from the first pair of opposite sides 11 and from the third pair of opposite sides 19 of the housing 3 by an angle of 90° relative to longitudinal axis of the control means 5. Alternately, the transverse holes 8 of the pair of second sliding members 4 and the number of transverse holes 30 of the first sliding member 2 may be slots, grooves or any other type of depression sized for receipt of the pins 7. When the pair of pins 7 of the lock assembly 1 are locked in the pair of transverse holes 8 of the pair of second sliding members 4 and in the number of transverse holes 30 of the first sliding member 2, the lock assembly 1 is aligned. When the pair of pins 7 of the lock assembly 1 are not locked in the pair of transverse holes 8 of the pair of second sliding members 4, the lock assembly 1 and the first sliding member 2 are free to move along the pair of second sliding members 4 and can be easily removed. The housing 3 may be either removably or irremovably secured to the first sliding member 2 by any suitable attaching means 10 to be received at one side 19' (i.e. back side 19') of the third pair of opposite sides 19 of the housing. In a preferred embodiment, the attaching means 10 is easily removable and reattachable and consists of screws and nails. The housing 3 is secured to the first sliding member 2 when holes from the back side 19' of the third pair of opposite sides 19 of the housing 3 are aligned with the attaching means 10. The attaching means 10 has a size and shape for reception through the holes from the back side 19' of the housing 3 but without reaching the first channel 51 or the second channel 53, such that the attaching means 10 contacts neither the pair of pins 7 nor the control means 5. (Please compare FIG. 1B with FIG. 2B.) With the attaching means 10 being seated in the holes from the back side 19', the housing 3 is locked against twisting or longitudinal movement relative to the first sliding member 2. When the housing 3 is locked onto the first sliding member 2, there is an increase in the stability of the lock assembly 1.

In another embodiment that is not shown in the drawings and that is described above, the first sliding member 2 consists of one wall 28 (i.e. an end wall 28', with no side walls). Therefore, the first sliding member 2 serves basically as a sheet to which the housing 3 of the lock assembly 1 is attached at its back side 19' and with which the housing 3 is only in contact from its back side 19', while the pair of pins 7 solely pass through the corresponding pair of transverse holes 8 of the pair of second sliding members 4. Since the first sliding member 2 does not have any side walls, each opposite side 15 of the second pair of opposite sides 15 of the housing 3 of the lock assembly 1 is embraced directly by the corresponding second sliding member 4 and the pins 7 do not pass through any other wall before entering the pair of second sliding members 4.

Not only can the attaching means 10 be easily removed and reattached, the lock assembly 1 itself can be easily removed, reassembled and reattached. In a preferred embodiment, the housing 3 presents a cubical body with four rectangular sides (the second pair of opposite sides 15 and the third pair of opposite sides 19) and two opposite rectangular ends (i.e. the first pair of opposite sides 11). (Please refer to FIG. 1A.) The first pair of openings 13, through which the control means 5 is pushed, are positioned on the two opposite rectangular ends which are the first pair of opposite sides 11 of the housing 3. (Please refer to FIG. 2A and FIG. 2B.) The second pair of openings 17, through which the pair of pins 7 move, are positioned on two opposite rectangular sides which are the second pair of opposite sides 15 of the housing 3. The second pair of openings 17 are preferably circular in shape. The cubical body is sized to be freely and easily slided amidst the side walls 28" of the first sliding member 2 (which is in turn amidst the pair of second sliding members 4 if the first sliding member 2 has side walls 28" through which the pair of pins 7 pass) or, otherwise, amidst the pair of second sliding members 4 (if the first sliding member 2 does not have side walls through which the pair of pins 7 pass). In a preferred embodiment, the pair of second sliding members 4 of the housing 3 are preferably semi-rectangular or U-shaped, are spaced apart from each other and open towards the cubical body of the housing 3, such that, if the first sliding member 2 does not have side walls through which the pair of pins 7 pass, the cubical body of the housing 3 is between, is in contact with and is directly embraced by the pair of second sliding members 4. The second pair of opposite sides 15 of the housing 3 are sufficiently close to the first sliding member 2 and to the pair of second sliding members 4 to disallow any undesired slipping of the housing 3, of the first sliding member 2 and of the pair of second sliding members 4. In addition, when the first sliding member 2 does not have side walls through which the pair of pins 7 pass, sufficient space exists between the end wall 6' of each second sliding member 4 (of the pair of second sliding members 4) and the corresponding second opposite side 15 (of the second pair of opposite sides 15) of the housing 3 to enable an easy operation of the lock assembly 1. On the other hand, when the first sliding member 2 has side walls 28" through which the pair of pins 7 pass, sufficient space exists between each side wall 28" of the first sliding member 2 and the end wall 6' of the corresponding second sliding member 4 (of the pair of second sliding members 4) to enable an easy operation of the lock assembly 1 (please refer to FIG. 2A and FIG. 2B). The first pair of openings 13 of the housing 3 are sized and shaped to allow for easy and troubleless receipt and movement of the control means 5 through the first pair of openings 13. The second pair of openings 17 of the housing 3 are sized and shaped to allow for easy and troubleless receipt and movement of the pair of pins 7 through the second pair of openings 17.

The control means 5 is pushed for starting and enhancing displacement of the pair of pins 7 from the locked position to the unlocked position (with the pair of pins 7 returning from the unlocked position to the locked position upon release of the control means 5), relative to a corresponding pair of transverse holes 8 mounted along the end walls 6' of the adjacent corresponding pair of second sliding members 4, as well as relative to a corresponding pair of transverse holes 30 mounted along the side walls 28" of the adjacent corresponding first sliding member 2 if the first sliding member 2 has side walls 28" through which the pair of pins 7 pass. An advantage of the present invention is that the lock assembly 1 is operated by manipulating only the control means 5. In a preferred embodiment, the control means 5 resembles a button that is unlocked by pushing the top section 25 of the control means 5 and that is locked upon being released. (Please refer to FIG. 1A, FIG. 2A and FIG. 2B.) An advantage of the control means 5 is its simplicity and low costs. The control means 5 does not need to be added or supplemented to a handle. The control means 5 can be simply manually, with only one hand (and to be even more particular with one finger and preferably with the thumb), pushed onto and removed from any desired space, saving costs and simplifying the process of set-up and application. Despite its simplicity and low cost, the control means 5 provides a quick release mechanism that is more stable and more durable than the quick release mechanism provided by existing handles.

The pair of pins 7 are being held by and supported by the housing 3 for shifting movement in a direction transverse to direction of movement of the control means 5 between a locked position and an unlocked position. If the first sliding member 2 does not have side walls through which the pair of pins 7 pass, when the pair of pins 7 are in a locked position, the pair of pins 7 extend directly into the pair of transverse holes 8 of the pair of second sliding members 4, and when the pair of pins 7 are in an unlocked position, the pair of pins 7 are withdrawn solely from the pair of transverse holes 8 of the pair of second sliding members 4. The pair of pins 7 are formed of metal, plastic or any other suitable material and can be round, square rectangular or other shape. Each pin 7 includes an external portion 27 (as shown in FIG. 1B) having a diameter substantially equal to the diameter of the corresponding transverse hole 8 of the corresponding second sliding member 4 (as well as to the diameter of the corresponding transverse hole 30 of the corresponding side wall 28" of the first sliding member 2 if the first sliding member 2 has side walls 28" through which the pair of pins 7 pass) to allow relatively smooth entrance and exit of the external portion 27 of the pin 7 into and out of the corresponding second sliding member 4 (and into and out of the first sliding member 2 if the first sliding member 2 has side walls 28" through which the pair of pins 7 pass). (Please refer to FIG. 2A and FIG. 2B.) Adjacent to the external portion 27 of each pin 7 is a portion in shape of a disc 29 that is of a larger diameter than the external portion 27 of the pin 7 and that prevents the pin 7 from extending beyond the external portion 27 into the end wall 6' of the corresponding second sliding member 4 (and into the corresponding side wall 28" of the first sliding member 2 if the first sliding member 2 has side walls 28" through which the external portion 27 of the pair of pins 7 pass). Attached to the disc 29 is an internal portion 31 of the pin 7 which is of a smaller diameter than the disc 29. (Please refer to FIG. 1B, FIG. 2A and FIG. 2B.) The internal portion 31 of each pin 7 consists of three sections: a front portion 33, a middle portion 35 and a back portion 37. The middle portion 35 of each pin 7 is of smallest diameter among the sections of the internal portion 31. By being of the smallest diameter among the front portion 33 and the back portion 37, the middle portion 35 forms a circumferential groove between the front portion 33 and the back portion 37 of the internal portion 31 of the pin 7.

The second channel 53, in which the pin 7 is positioned and through which the pin 7 moves while being locked and unlocked, comprises an outer section 53" with a back wall 69 and an inner section 53'. (Please refer to FIG. 2A and FIG. 2B.) The inner section 53' has a diameter that is smaller than diameter of the outer section 53", with the diameters having an optional size depending upon application of the lock assembly 1, design of the pin 7 and distance between housing 3 and the corresponding second sliding member 4 of the pair of second sliding members 4, to name a few. The diameter of the inner section 53' is slightly larger than the diameter of the back portion 37 of the internal portion 31 of the pin 7 in order to enable passage of the back portion 37 through the inner section 53' when the lock assembly 1 is being set up and when the lock assembly 1 is being disassembled. Thus, the diameter of the middle portion 35, which is smaller than the diameter of the back portion 37, of the internal portion 31 of the pin 7 is smaller than the diameter of the inner section 53' and is passed through the inner section 53' with some empty space between the middle portion 35 of the internal portion 31 of the pin 7 and the inner section 53' of the second channel 53. Meanwhile, the front portion 33 of the internal portion 31 of the pin 7 is slightly smaller in diameter than the inner section 53' of the second channel 53, sufficiently smaller to enable the front portion 33 to slide smoothly in the inner section 53' when the pin 7 is locked and unlocked but not smaller enough to allow the passage of the spring 9 that is around the front portion 33 into the inner section 53'. The spring 9 has a diameter that is larger than the diameter of the inner section 53' of the second channel 53, although smaller than the diameter of the outer section 53" of the second channel 53. (Please refer to FIG. 1B and FIG. 2B.) Therefore, when the pin 7 is unlocked or locked, a portion of the internal portion 31 of the pin 7 that is not surrounded by the spring 9 moves into or out of the inner section 53' of the second channel 53, while a portion of the internal portion 31 of the pin 7 that is surrounded by the spring 9 remains in the outer section 53" of the second channel 53. (Please refer to FIG. 2A and FIG. 2B.) In addition, the disc 29 of the pin 7 has a diameter that is slightly smaller than the diameter of the outer section 53" of the second channel 53 and, therefore can smoothly slide along the outer section 53" of the second channel 53. Of course, with the spring 9 being between the disc 29 and the back wall 69 of the outer section 53" of the second channel 53 and with both the spring 9 and the disc 29 having a larger diameter than the inner section 53' of the second channel 53, the disc 29 is prevented from entering the inner section 53'. (Please refer to FIG. 2B.) The external portion 27 of the pin 7 is smaller in diameter than the outer section 53" of the second channel 53 and than the disc 29 (as shown in FIG. 1B and FIG. 2A). Some free space exists between all components of the pin 7 and the outer section 53" (as shown in FIG. 2A). Therefore, when the pin 7 is locked and unlocked, the pin 7 moves easily out of and into the outer section 53" of the second channel 53. Also, as noted before, the external portion 27 of the pin 7 is sufficiently small in diameter to allow smooth entrance of and exit of the external portion 27 of the pin 7 into and out of the transverse hole 8 of the end wall 6' of each second sliding member 4 (and into the transverse hole 30 of the corresponding side wall 28" of the first sliding member 2 if the first sliding member 2 has side walls 28" through which the external portion 27 of the pair of pins 7 pass). However, the disc 29 has a diameter that is larger than the diameter of the transverse hole 8 of the end wall 6' of each second sliding member 4 (and larger than the diameter of the transverse hole 30 of the corresponding side wall 28" of the first sliding member 2 if the first sliding member 2 has side walls 28" through which the external portion 27 of the pair of pins 7 pass). Therefore, the disc 29 is stopped at the second sliding member 4 (i.e., if the first sliding member 2 does not have side walls 28" through which the external portion 27 of the pair of pins 7 pass) or at the first sliding member 2 (i.e., if the first sliding member 2 has side walls 28" through which the external portion 27 of the pair of pins 7 pass).

In a preferred embodiment, when the pin 7 is in locked position, the external portion 27 of the pin 7 extends out of the outer section 53" of the second channel 53 and the disc 29 is at external end of the outer section 53" of the second channel 53 and is adjacent to the corresponding second opposite side 15 of the second pair of opposite sides 15 of the housing 3. (Refer to FIG. 2A.) Meanwhile, a portion of the front portion 33 of the internal portion 31 of the pin 7 extends along the outer section 53" of the second channel 53 and any remaining portion of the front portion 33 of and a portion of the middle portion 35 of the internal portion 31 of the pin 7 extend along the inner section 53' of the second channel 53. Simultaneously, any remaining portion of the middle portion 35 of the pin 7 and the back portion 37 of the pin 7 rest in the cut-out section 21 of the control means 5 even when the pin 7 is locked and are easily guided through the cut-out section 21 of the control means 5 when the pin 7 is unlocked. Therefore, the pin 7 has a design that is particularly shaped to facilitate the movement of the pin 7 through the second channel 53 and transversal to the first channel 51 and, thus, transversal to the direction of movement of the control means 5.

The spring 9, which is preferably formed of metal, plastic or the like, for each pin 7 is around a portion of the front portion 33 of the internal portion 31 of the pin 7, the portion of the front portion 33 that remains in the outer section 53" of the second channel 53. (Please compare FIG. 2A with FIG. 2B.) The spring 9 is longer than the outer section 53" of the second channel 53 (since when the pin 7 is locked, the spring 9 extends all along the outer section 53" of the second channel 53, from the back wall 69 of the outer section 53" to the disc 29 at the corresponding second opening 17 of the second pair of openings 17 of the corresponding second opposite side 15 of the second pair of opposite sides 15). The spring 9 for each corresponding pin 7 pushes behind the corresponding disc 29, causing the corresponding pin 7 to return to the locked position and remain in the locked position thereafter until the control means 5 is pushed again. The tension of the spring 9 pushes the pin 7 outwards, keeps the pin 7 in position and keeps the lock assembly 1 locked at all times until the control means 5 is pushed. When the control means 5 is being pushed from the locked position to the unlocked position, the spring 9 is being pressed farther back between the disc 29 of the pin 7 and the back wall 69 of the outer section 53" of the second channel 53 while the pin 7 is shifting inwards (as shown in FIG. 2B). While the pin 7 remains unlocked, the spring 9 shall remain compressed. The spring 9 is preferably retained unilaterally around a portion of the front portion 33 of the internal portion 31 of the pin 7, the portion that rests in the outer section 53" of the second channel 53. The back portion 37 and the middle portion 35 of the pin 7 are adapted to receive the spring 9 during loading of the spring 9 onto the pin 7 and the spring 9 is positioned and adjusted to remain on the portion of the front portion 33 of the pin 7 that rests in the outer section 53" of the second channel 53, as the pin 7 is moved between the locked position and the unlocked position deeper into the housing 3 and into the control means 5 of the lock assembly 1. The back portion 37 of and the middle portion 35 of the internal portion 31 of the pin 7 are sized and designed to fit in the cut-out section 21 of the corresponding opposite side section 23 of the control means 5. The cut-out section 21 of the control means 5 consists of a first section 39 that is preferably rectangular in shape and a remaining section 41 that is preferably basically circular in shape. (Please refer to FIG. 1B, FIG. 2A and FIG. 2B.) The first section 39 of the cut-out section 21 has a width that is smaller than diameter of the remaining section 41 of the cut-out section 21. The width of the first section 39 of the cut-out section 21 of the control means 5 is smaller than the diameter of the back portion 37 of the internal portion 31 of the pin 7. However, the diameter of the remaining section 41 of the cut-out section 21 of the control means 5 is large enough to allow passage of the back portion 37 of the internal portion 31 of the pin 7. The back portion 37 of the internal portion 31 of the pin 7 is passed through the remaining section 41 of the cut-out section 21 and placed into the cut-out section 21. Thus, the pair of pins 7 are placed in their assigned positions in the control means 5 and in the housing 3 (with the external portion 27 of the pair of pins 7 extending out of the housing 3 of the lock assembly 1 when the control means 5 is in the locked position as shown in FIG. 1A). However, after the pair of pins 7 are placed in the control means 5, since the back portion 37 of the internal portion 31 of each pin 7 has a diameter that is smaller than the width of the first section 39 of the cut-out section 21 of the control means 5, the back portion 37 of the internal portion 31 of the pin 7 cannot exit the control means 5 via the first section 39 of the cut-out section 21. This blocking of the back portion 37 of the internal portion 31 of the pin 7 by the first section 39 of the cut-out section 21 of the control means 5 is one location where the pair of pins 7 and the control means 5 are prevented from exiting the lock assembly 1. The back portion 37 and the middle portion 35 of each pin 7 each has a diameter that is sufficiently small to allow intrusion of the back portion 37 and of the middle portion 35 into the remaining section 41 and resting of the back portion 37 and of the middle portion 35 within the remaining section 41 of the cut-out section 21 while the pin 7 is locked and while the pin 7 is being locked and unlocked. In addition, the width of the first section 39 of the cut-out section 21 is sufficiently large to allow smooth and troubleless movement of the middle portion 35 of the internal portion 31 along the first section 39, but is sufficiently small to prevent exit of the back portion 37 of the internal portion 31 from the first section 39 of the cut-out section 21. Meanwhile, the diameter of the remaining section 41 is large enough to allow smooth and troubleless movement of the middle portion 35 and of the back portion 37 of the internal portion 31 of the pin 7 through the remaining section 41. The first section 39 is limited by an upper edge 43 and the remaining section 41 is limited by a lower edge 45 (not shown in FIG. 1A). (Please refer to FIG. 1A, FIG. 1B, FIG. 2A and FIG. 2B.) The upper edge 43 and the lower edge 45 of each cut-out section 21 set the limits of movement of each pin 7. The secondary channel 57 extends between and through the cut-out section 21 of the pair of opposite side sections 23 of the control means 5 during locked and unlocked conditions.

On the other hand, the front section 47 and the back section 49 of the control means 5 of the lock assembly 1 each has a supplemental cut-out section 67. (Please refer to FIG. 1A and FIG. 1B.) The primary channel 55 extends between the front section 47 and the back section 49. The supplemental cut-out sections 67 are designed to enhance the smooth and troubleless movement of the pins 7. Each supplemental cut-out section 67 preferably comprises a pair of opposite slanted sides 61, a top edge 63 and a bottom edge 65. (Please refer to FIG. 1B, FIG. 2A and FIG. 2B.) In a preferred embodiment, the pair of opposite slanted sides 61 run in convergence to each other towards the top edge 63 (shown in FIGS. 1A and FIG. 1B) and run in divergence to each other towards the bottom edge 65 (shown in FIG. 1B). Thus, the top edge 63 of the supplemental cutout section 67 is shorter than the bottom edge 65 of the supplemental cut-out section 67. Since, in addition, the diameter of the back portion 37 of the internal portion 31 of each pin 7 is larger than the width of the first section 39 of the cut-out section 21 of the control means 5, as the control means 5 is pushed in one direction, a force is exerted by the control means 5 on the back portion 37 of the internal portion 31 of each pin 7 to force the pin 7 to move in an opposite direction. The middle portion 35 of the pin 7 moves along the first section 39 (i.e. any distance existing between the back portion 37 of the internal portion 31 and the corresponding opposite side section 23 of the pair of opposite side sections 23 increases as the control means 5 is pushed in the one direction). As a result, each pin 7 commences to move inwards towards and deeper into the control means 5 and out of and away from the end wall 6' of the corresponding second sliding member 4 of the pair of second sliding members 4 when the control means 5 is pushed. Such tapered designs of the supplemental cut-out section 67 of the control means 5 are used in order to guide movement of the pair of pins 7 through the control means 5 so that each pin 7 snaps into the corresponding opposite slanted side 61 (of the pair of opposite slanted sides 61) of the supplemental cut-out section 67 until the control means 5 is released. Before the control means 5 is released, the pair of pins 7 cannot either twist or be moved longitudinally relative to the control means 5. In order to relock the pair of pins 7, it is necessary only to release the control means 5, such that each pin 7 reaches the bottom edge 65 of the supplemental cut-out section 67 and such that the corresponding spring 9 shifts the corresponding pin 7 away from the control means 5 and toward the end wall 6' of the corresponding second sliding member 4 of the pair of second sliding members 4 (and also toward the corresponding side wall 28" of the first sliding member 2, if the first sliding member 2 has side walls 28" through which the external portion 27 of the pair of pins 7 pass).

In a preferred embodiment, the external portion 27 of each pin 7 that exits the transverse hole 8 of the end wall 6' of each second sliding member 4 (and that exits the number of transverse holes 30 of the first sliding member 2 if the first sliding member 2 has side walls 28" through which the external portion 27 of the pair of pins 7 pass) moves a specific distance to switch from a locked position to an unlocked position and vice versa (referred to as "locking distance"). Said locking distance is tangent of slope of the pair of opposite slanted sides 61 of the supplemental cut-out section 67 of the control means 5 that preferably ranges from approximately 45° to approximately 60°. The middle portion 35 of the internal portion 31 of the pin 7 is slightly longer than the locking distance, such that upon unlocking of the pin 7, a portion of the middle portion 35 still remains in the inner section 53' of the second channel 53 of the housing 3.

The housing 3 is positioned directly between the pair of second sliding members 4 if the first sliding member 2 does not have side walls through which the pair of pins 7 pass, while the position of the pair of pins 7 is controlled by the control means 5 and the housing 3 is connected by attaching means 10 to the first sliding member 2. On the other hand, if the first sliding member 2 has side walls 28" through which the external portion 27 of the pair of pins 7 pass, each side wall 28" of the first sliding member 2 is positioned between the housing 3 and the end wall 6' of the corresponding second sliding member 4 of the pair of second sliding members 4. As the first section 39 of each cut-out section 21 of the control means 5 moves along the middle portion 35 of the internal portion 31 of the corresponding pin 7, the presence of the pair of opposite slanted sides 61 of the supplemental cut-out section 67 results in inward movement of each pin 7 into the control means 5, and thus into the housing 3, of the lock assembly 1 and away from the end wall 6' of the corresponding second sliding member 4 of the pair of second sliding members 4. The disc 29 of each pin 7 blocks the escape of the pin 7 through the corresponding transverse hole 8 of the corresponding second sliding member 4 of the pair of second sliding members 4 (and also through the corresponding transverse hole 30 of the first sliding member 2 if the first sliding member 2 has a number of transverse holes 30 through which the external portion 27 of the pair of pins 7 pass) when the pair of pins 7 lock. Similarly, the back portion 37 of the internal portion 31 prevents the escape of the pin 7 through the first section 39 of the cut-out section 21 of the control means 5 and through the housing 3 and, as a result, prevents the escape of the control means 5 through the housing 3 when the pair of pins 7 lock. In a preferred embodiment, as the middle portions 35 of the internal portions 31 of the pair of pins 7 move into the control means 5, the external portions 27 of the pair of pins 7 enter the housing 3. Meanwhile, as the external portions 27 of the pair of pins 7 enter the housing 3, the back portions 37 of the internal portions 31 of the pair of pins 7 protrude at the same rate deeper into the cut-out section 21 of the control means 5.

The remaining section 41 of the cut-out section 21 of the control means 5 has a diameter about equal in size to the diameter of the back portion 37, which is larger in diameter than the middle portion 35, of the internal portion 31 of each pin 7. As the control means 5 is pushed, it exerts a force on the back portion 37 of the internal portion 31 of each pin 7 to lift the pin 7. When the control means 5 is pushed to an extent to create a force that reaches a magnitude sufficient to retrieve the external portion 27 of each pin 7 out of the corresponding transverse hole 8 of the pair of second sliding members 4, the pair of pins 7 snap into unlocked position. This movement of the pair of pins 7 shifts the pair of pins 7 into a depression into the housing 3 of the lock assembly 1, withdrawing the pair of pins 7 deeper into the second pair of openings 17 of the housing 3. When the control means 5 is pushed, the pair of pins 7 shift inwards and the corresponding spring 9 is further compressed, reserving any bounce back energy. Thereafter, when the control means 5 is released, so is the spring 9 for each pin 7. The spring 9 for each pin 7 pushes behind the corresponding disc 29, causing the pair of pins 7 to return to the locked position again and to remain in locked position thereafter until the control means 5 is pushed. When the control means 5 is released at a selected position where the pair of pins 7 are adjacent to a selected pair of transverse holes 8 of the pair of second sliding members 4 (and also adjacent to the corresponding pair of transverse holes 30 of the first sliding member 2 if the first sliding member 2 has a number of transverse holes 30 through which the external portion 27 of the pair of pins 7 pass), the pair of pins 7 are released with sufficient pressure to automatically jump into the selected pair of transverse holes 8 of the pair of second sliding members 4 (and also into the selected pair of transverse holes 30 of the first sliding member 2). Upon being released, the control means 5 automatically returns to its original position. As the control means 5 returns to its original position, the back portion 37 of the internal portion 31 of each pin 7 moves towards the corresponding remaining section 41 of the cut-out section 21, the middle portion 35 of the internal portion 31 of each pin 7 returns partly into the inner section 53' of the corresponding second channel 53 upon moving partly out of the control means 5, the front portion 33 of the internal portion 31 of each pin 7 shifts from the inner section 53' of the corresponding second channel 53 toward the outer section 53" of the corresponding second channel 53, the disc 29 of each pin 7 moves in the outer section 53" of the corresponding second channel 53 to the corresponding second opening 17 of the second pair of openings 17 of the second pair of opposite sides 15 and, finally, the external portion 27 of each pin 7 jumps out into the selected corresponding transverse hole 8 of the corresponding second sliding member 4 of the pair of second sliding members 4. When pressure is exerted upon the pair of pins 7, the disc 29 of each pin 7 prohibits the escape of the pin 7 through the corresponding transverse hole 8 of the corresponding second sliding member 4 of the pair of second sliding members 4 (and also through the corresponding transverse hole 30 of the first sliding member 2 if the first sliding member 2 has a number of transverse holes 30 through which the external portion 27 of the pair of pins 7 pass), with the disc 29 of each pin 7 being larger in diameter than the corresponding transverse hole 8 of the corresponding second sliding member 4 of the pair of second sliding members 4 (and also larger in diameter than the corresponding transverse hole 30 of the first sliding member 2 if the first sliding member 2 has a number of transverse holes 30 through which the external portion 27 of the pair of pins 7 pass).

As demonstrated above, application of the lock assembly 1 enables support of the first sliding member 2 at various positions of placement of the lock assembly 1 amidst the pair of second sliding members 4. In a preferred embodiment, the first sliding member 2 is mounted in a nested manner along the pair of second sliding members 4, with the lock assembly 1 being located at vertically spaced positions in general alignment with the selected pair of transverse holes 8 of the pair of second sliding members 4 (and also simultaneously in general alignment with the selected pair of transverse holes 30 of the first sliding member 2, if the first sliding member 2 has a number of transverse holes 30 through which the external portion 27 of the pair of pins 7 pass).

In cases where one pin 7 is used (as shown in FIG. 3 and FIG. 4), the lock assembly 1 comprises a housing 3 consisting of a first opening 13' and a second opening 17', a cap 12 that covers the second opening 17', a control means 5 comprising a cut-out section 21 with a lower edge 45 and an upper edge 43 and being shifted by a user upon the housing 3 from the first opening 13' where the control means 5 is pushed from a locked position to an unlocked position (and automatically returning to the locked position upon being released), a pin 7 being held by and supported by the housing 3 and automatically shifting towards the second opening 17' in a direction transverse to direction of shifting of the control means 5 and between the locked position and the unlocked position (and automatically shifting back to the locked position upon being released), a first spring 9' being positioned upon the pin 7 for enhancing the shifting movement of the pin 7 from the unlocked position back to the locked position (and also for holding the pin 7 in the locked position until the control means 5 is pushed again) and a second spring 9" in front of the control means 5 for pushing the control means 5 backward to its original locked position which is the lower edge 45 of the cut-out section 21, such that when the control means 5 is pushed from the locked position to the unlocked position and the lock assembly 1 is unlocked, the pin 7 automatically shifts towards the second opening 17' and such that when the control means 5 is released, the second spring 9" shifts the control means 5 toward the first opening 13' and transversal to the pin 7. The control means 5 shifts back from the unlocked position to the locked position, the pin 7 automatically shifts inwards, through the cut-out section 21 of the control means 5, into the corresponding transverse hole 8 of the second sliding member 4, through and away from the second opening 17' and is held therein in locked position, and the lock assembly 1 is locked until the control means 5 is pushed. In a preferred embodiment, the lock assembly 1 is attached to a first sliding member 2 and a second sliding member 4 that has a wall 6 through which a number of transverse holes 8 extend.

By providing an extension 14 with a lock assembly 1 having one pin 7 connected to a control means 5 (as shown in FIG. 4), it is possible to insert and lock a tool (not shown) in place on the extension 14 by pushing the control means 5. As shown in FIG. 3 and FIG. 4, the control means 5 comprises a top section 25, a pair of opposite side sections 23 having each a cut-out section 21 and consisting of a first opposite side section 23', that is slanted downwardly away from the top section 25, and a flat second opposite side section 23", a front section 47, a back section 49, a bottom section 59, an intermediary top section 34 that is between the bottom section 59 and the top section 25 and that marks top of the first opposite side section 23' and of the second opposite side section 23" and a support 32 for the top section 25, with the support 32 preferably consisting of a surface that leads to and that attaches the top section 25 to the first opposite side section 23' (with the front section 47 and the back section 49 not shown in FIG. 4). The pin 7 passes in, through and along the cut-out section 21 of the first opposite side section 23' and of the second opposite side section 23" of the control means 5 as the control means 5 is being locked and unlocked.

The lock assembly 1 may be used for locking a tool on end of the extension 14 and for moving the tool. In a preferred embodiment, the pin 7 is in contact with the second sliding member 4 to which the tool is also attached. By moving the control means 5, the user can change the position of the tool with respect to the second sliding member 4. An elongated member may serve as the first sliding member 2 and may be formed of metal or any other suitable material capable of supporting the tool at one end thereof while permitting a user to grip the first sliding member 2. The tool and/or extension 14 can be easily and quickly released with the push of the top section 25 of the control means 5, and it is not necessary to unscrew the tool as required with conventional extensions or tools. By simply pushing the top section 25 of the control means 5, the control means 5 moves forward and additional free space is provided between the first opposite side section 23' and the second opposite side section 23" (with the first opposite side section 23' being slanted downwards in direction of unlocking of the control means 5). The provision of the additional free space causes the pin 7 to exit from the transverse hole 8 that extends through the wall 6 of the second sliding member 4, such that the second sliding member 4 is free to move to a desired position. At the desired position, the top section 25 of the control means 5 is released, causing the pin 7 in contact with the control means 5 to enter the adjacent transverse hole 8 in the wall 6 of the second sliding member 4 such that the extension 14 is held stably in the desired position. The pin 7 also holds the extension 14 or tool against both longitudinal and rotational movement relative to the lock assembly 1. An end of the second sliding member 4 and first sliding member 2 that is farther from the tool may be open or closed.

In housings 3 where only one pin 7 is used, the first opening 13' leads to a first channel 51 and the second opening 17' leads to a second channel 53 in the housing 3. The first channel 51 and the second channel 53 intersect in the housing 3. The first channel 51 extends across the housing 3 in one direction, while the second channel 53 extends across the housing 3 in a transverse direction. The control means 5 is positioned in the first channel 51 and the pin 7 is positioned in the second channel 53. As a result, the pin 7 can be forced to move through the second channel 53 and the control means 5 can be pushed through the first channel 51.

The housing 3 is supported stably by the first sliding member 2 when the pin 7 of the lock assembly 1 is locked in a transverse hole 8 that extends through the wall 6 of the second sliding member 4. A number of transverse holes 8 extend through the wall 6 of the second sliding member 4, with a selected transverse hole 8 of the second sliding member 4 being positioned adjacent to and under the second opening 17' of the housing 3 of the lock assembly 1. The transverse hole 8 of the second sliding member 4 is positioned under the second opening 17' of the housing 3 of the lock assembly 1 and is spaced circumferentially from the housing 3 by an angle of 90° relative to the longitudinal axis of the control means 5. Alternately, the transverse holes 8 of the second sliding member 4 may be slots, grooves or any other type of depression sized for receipt of the pin 7. When the pin 7 of the lock assembly 1 is locked in a transverse hole 8 of the wall 6 of the second sliding member 4, the lock assembly 1 is aligned. When the pin 7 of the lock assembly 1 is not locked in a transverse hole 8 of the wall 6 of the second sliding member 4, the housing 3 is free to move. In a preferred embodiment, the housing 3 is irremovably secured to the first sliding member 2. The second sliding member 4 is easily removable and reattachable while the first sliding member 2 is fixed to the housing 3. However, in another embodiment of the lock assembly 1, wherein one pin 7 is used, the first sliding member 2 is easily removable and reattachable as well while the pin 7 passes through a transverse hole 30 of the first sliding member 2.

Not only is the second sliding member 4 easily removable and reattachable, the lock assembly 1 itself is easily removable, reassemblable and reattachable. In a preferred embodiment, the housing 3 comprises a semi-cylindrical body 24 attached to a raised top 26 that has a pair of side walls 36, a back wall 38 and a top wall 40. The semicylindrical body 24 and the raised top 26 each have a first end 16 and a second end 18. The first opening 13' marks the commencement of the first channel 51 through which the control means 5 is pushed. The first channel 51 starts on the first end 16 of the housing 3, runs between and along the pair of side walls 36 of the raised top 26 and extends until the back wall 38 of the raised top 26 of the housing 3. The second opening 17' marks the commencement of the second channel 53 that extends directly to and through an underlying transverse hole 42 of the semi-cylindrical body 24 and, then, through the selected transverse hole 8 of the second sliding member 4. Therefore, the second channel 53 extends directly from the second opening 17' of the housing 3 and from the top wall 40 to the selected transverse hole 42 of the semi-cylindrical body 24 and to the selected transverse hole 8 of the second sliding member 4. The second opening 17', through which the pin 7 moves, is in the top wall 40 of the raised top 26 of the housing 3. The second opening 17' is preferably circular in shape. The lock assembly 1 is shaped and sized to allow free and easy sliding of the second sliding member 4 amidst the first sliding member 2 and amidst the lock assembly 1. A part of the first sliding member 2 is preferably cylindrical and opens towards the housing 3, such that a part of the first sliding member 2 is between the second sliding member 4 and the semi-cylindrical body 24 of the housing 3 and is embraced by the housing 3. The control means 5 is sufficiently close to the first sliding member 2 and to the second sliding member 4 to disallow any undesired slippage of the first sliding member 2 and of the second sliding member 4. However, sufficient space exists between the first sliding member 2, the second sliding member 4 and the control means 5 to enable an easy operation of the lock assembly 1. The first opening 13' of the housing 3 is sized and shaped to allow for easy and troubleless receipt and movement of the control means 5 through the first opening 13'. The second opening 17' is sized and shaped to allow for easy and troubleless receipt and insertion of the pin 7 and of the first spring 9' through the second opening 17' and for simple closing of the second opening 17' by the cap 12.

The control means 5 is used for displacing the pin 7 from a locked position to an unlocked position, and vice versa, relative to a corresponding transverse hole 8 mounted in the wall 6 of the adjacent corresponding second sliding member 4. In a preferred embodiment, the control means 5 is unlocked upon pushing the top section 25 of the control means 5 and locked upon releasing the top section 25. In embodiments in which the first sliding member 2 does not reach the second channel 53 (as shown in FIG. 4), the pin 7 naturally does not pass through the first sliding member 2 and solely passes through the selected transverse hole 8 of the wall 6 of the second sliding member 4 and through the transverse hole 42 of the semi-cylindrical body 24. However, in any embodiment in which the first sliding member 2 reaches the second channel 53 (not shown in figures), the pin 7 passes through the selected transverse hole 30 (not shown) of the first sliding member 2 and through the selected transverse hole 8 of the second sliding member 4, as well as through the transverse hole 42 of the semi-cylindrical body 24. In all embodiments, the pin 7 passes through a cut-out section 21 in the first opposite side section 23' and in the second opposite side section 23". An advantage of the control means 5 is its simplicity and low costs. The control means 5 does not need to be added or supplemented to a handle. The control means 5 can be simply manually, with only one hand (and to be even more particular with one finger and preferably with the thumb), pushed onto and removed from any surface, saving costs and simplifying the process of set-up and application. Despite its simplicity and low cost, the control means 5 provides a quick release mechanism that is more stable and more durable than the quick release mechanism provided by existing handles.

The pin 7 is constantly supported by the housing 3 for shifting movement in a direction transverse to direction of movement of the control means 5 between a locked position extending into the selected transverse hole 8 of the second sliding member 4 and an unlocked position withdrawn from the transverse hole 8 of the second sliding member 4. The pin 7 is formed of metal, plastic or any other suitable material and can be round, square rectangular or other shape. Each pin 7 includes a vertical portion 20 having a diameter substantially equal to the diameter of the transverse hole 8 of the second sliding member 4 and substantially equal to the diameter of the transverse hole 42 of the semi-cylindrical body 24 to allow relatively smooth entrance and exit of the vertical portion 20 of the pin 7 into and out of the transverse hole 8 of the second sliding member 4 and into and out of the selected transverse hole 42 of the semi-cylindrical body 24, respectively. If the first sliding member 2 reaches the second channel 53, the diameter of the vertical portion 20 of the pin 7 must be substantially equal to the diameter of the selected transverse hole 30 of the first sliding member 2. In a preferred embodiment, a top portion of the pin 7 above the vertical portion 20 of the pin 7 is in shape of a ring (i.e. referred to as "ringular portion 22" of the pin 7). The ringular portion 22 is attached to a curved, circular base 44 that is between the ringular portion 22 and the vertical portion 20. The cap 12 is preferably placed above the pin 7 in an upside-down position and has a U-shaped cross-section. The cap 12 is positioned upon the top wall 40 of the raised top 26 of the housing 3. The cap 12 is easily removable and reattachable for positioning the pin 7 in and removing the pin 7 from the second channel 53. The ringular portion 22, in combination with the curved, circular base 44, of the pin 7 form a U-shaped cross-sectional structure wherein the first spring 9' is embraced. As a result, when the cap 12 is positioned above the first spring 9' and upon the top wall 40 of the raised top 26 of the housing 3, the first spring 9' is basically encapsulated between the cap 12 and the pin 7. The ringular portion 22 of the pin 7 is of a larger diameter than the vertical portion 20 of the pin 7 and than width of the cut-out section 21 of the control means 5 and, thus, prevents the pin 7 from extending into the control means 5 beyond the vertical portion 20 of the pin 7. In addition, some free space exists between the cap 12 and the ringular portion 22 of the pin 7. As a result, a circumferential groove is formed between the ringular portion 22 of the pin 7 and the cap 12. The first spring 9' extends directly from the cap 12 to the curved, circular base 44 of the pin 7 and is positioned in the circumferential groove. The first spring 9', which is preferably formed of metal, plastic or the like, is pressed between the cap 12 and the curved, circular base 44 of the pin 7, to ensure the pin 7 is in locked position, when the pin 7 moves out of the traverse hole 8 of the second sliding member 4. The first spring 9' and the second spring 9" are preferably retained in a transverse direction to one another, with the second spring 9" moving perpendicularly to direction of movement of the pin 7 and the first spring 9' moving in parallel to direction of movement of the pin 7. The circumferential groove is adapted to hold the first spring 9' and to retain the first spring 9' as the pin 7 is moved between the locked and unlocked positions.

The vertical portion 20, the ringular portion 22 and the curved, circular base 44 of the pin 7 are sized and designed to match dimensions and shape of the cut-out section 21 of the control means 5. The cut-out section 21 of the control means 5 comprises a first section 39 with a larger depth and a remaining section 41 with a smaller depth. The first section 39 is limited by the upper edge 43 and the remaining section 41 is limited by the lower edge 45. The first section 39 and the remaining section 41 preferably have a constantly decreasing depth, with the lower edge 45 having the smallest depth and the upper edge 43 having the largest depth. Such tapered designs of the cut-out section 21 of the control means 5 are used in order to guide movement of the pin 7 through the control means 5 so that the pin 7 is snapped into the upper edge 43 until the control means 5 is released. Before the control means 5 is released, the pin 7 cannot either twist or be moved longitudinally relative to the control means 5. In order to unlock the pin 7, it is necessary only to push the control means 5 such that the pin 7 shifts from the remaining section 41 of the cut-out section 21 of the control means 5 to the first section 39 of the cut-out section 21.

Upon being unlocked, the pin 7 is prevented from exiting the housing 3 via numerous means. When the pin 7 is unlocked, a section of the vertical portion 20 of the pin 7 remains in the cut-out section 21 of the control means 5. The section of the vertical portion 20 of the pin 7 that remains in the cut-out section 21 blocks any further movement of the control means 5 when the section of the vertical portion 20 of the pin 7 rests against the upper edge 43 of the cut-out section 21. This blocking of a section of the vertical portion 20 of the pin 7 by the upper edge 43 of the cut-out section 21 of the control means 5 is one location where the pin 7 and the control means 5 are prevented from exiting the lock assembly 1. In addition, the pin 7 is topped by and prevented from exiting the lock assembly 1 by the cap 12. When the control means 5 is unlocked, the cut-out section 21 of the control means 5 moves along the vertical portion 20 of the pin 7. While the control means 5 is being pushed forward, the pin 7 moves farther from the second sliding member 4. As the control means 5 moves in a transverse direction to the vertical portion 20 of the pin 7, the pin 7 automatically moves toward the cap 12 and away from the second sliding member 4. Meanwhile, as the vertical portion 20 of the pin 7 moves out of the transverse hole 8 of the second sliding member 4, the vertical portion 20 of the pin 7 protrudes at the same rate deeper into the cut-out section 21 of the control means 5 and the ringular portion 22 of the pin 7 protrudes at the same rate deeper into the circumferential groove of the housing 3. The cap 12 prevents the escape of the pin 7 through the second opening 17' of the housing 3. Meanwhile, the upper edge 43 of the cut-out section 21 prevents the escape of the pin 7 through the control means 5 and, thus, through the housing 3. (When the pin 7 is bounced back by the first spring 9' towards the transverse hole 8 of the second sliding member 4, the curved, circular base 44 of and the ringular portion 22 of the pin 7, being larger in diameter than the cut-out section 21 of the control means 5, prevent escape of the pin 7 through the cut-out section 21 of the control means 5 and, thus, through the transverse hole 8 of the second sliding member 4, as well as through the transverse hole 30 of the first sliding member 2 if the first sliding member 2 extends under the pin 7).

The remaining section 41 of the cut-out section 21 of the control means 5 includes a lower edge 45 having a diameter about equal to the diameter of the vertical portion 20 of the pin 7. As the control means 5 is being unlocked, it exerts a force on the curved, circular base 44 of the pin 7 that is counteracted by a force in an opposite direction by the lower edge 45 of the remaining section 41 of the cut-out section 21 of the control means 5 when the control means 5 is being locked. When the control means 5 is pushed to an extent to create a force that reaches a magnitude sufficient to retrieve the pin 7 out of the transverse hole 8, the pin 7 snaps into unlocked position. This movement of the pin 7 shifts the pin 7 into the housing 3 of the lock assembly 1, withdrawing the pin 7 up towards the cap 12. Thereafter, when the control means 5 is released, the first spring 9' and the second spring 9" cause the pin 7 to return to the locked position again. When the control means 5 is released at a selected position where the pin 7 is adjacent to a selected transverse hole 8, the pin 7 is released with sufficient pressure to automatically jump into the selected transverse hole 8 of the second sliding member 4 (as well as into the transverse hole 30 of the first sliding member 2 if the first sliding member 2 extends under the pin 7). Upon being released, the control means 5 automatically returns to its original position. As the control means 5 returns to its original position, a section of the vertical portion 20 of the pin 7 jumps into the selected transverse hole 8 of the wall 6 of the second sliding member 4. The curved, circular base 44 of the pin 7 is a means that prohibits the escape of the pin 7 from the housing 3 through the transverse hole 8 of the wall 6 of the second sliding member 4 (as well as through the transverse hole 30 of the first sliding member 2 if the first sliding member 2 extends under the pin 7) when such a pressure is exerted upon the pin 7.

The lock assembly 1 enables support of the second sliding member 4 at various positions of placement of the second sliding member 4 within the lock assembly 1. In a preferred embodiment, the second sliding member 4 is mounted in a nested manner along the first sliding member 2, with the lock assembly 1 being located at vertically spaced positions in general alignment with the transverse holes 8 of the second sliding member 2.

A lock assembly 1 with two pins 7, that resembles the set-up of the lock assembly 1 with one pin 7, may also be used for high security locking of tools, poles and other similar embodiments. The difference is the use of a lock assembly 1 comprising two housings 3 that are basically mirror images of one another. As a result, upon pushing the control means 5 of the two lock assemblies 1, the user can simultaneously unlock two pins 7. Similarly, upon releasing the control means 5 of the two lock assemblies 1, the user can simultaneously lock the two pins 7.

By providing a construction in accordance with the present invention, numerous advantages are realized. The multi-point lock assembly 1 provides an easily operated high security lock device for use with sliding doors, sliding windows, stilts, benches, poles and other similar devices. The lock assembly 1 permits the locking and unlocking of such devices without impact or noise, by simply pushing the control means 5, without it being necessary to act on a handle of a lock. Opening of the lock assembly 1 is prevented unless and until the control means 5 is pushed manually. If the lock assembly 1 has been unlocked by pushing the control means 5, the lock assembly 1 is immediately and automatically locked when the control means 5 is released so that there is no need for the user to remember to lock the lock assembly 1. The mechanism of the present invention is relatively simple and straightforward and can be constructed at a relatively low cost. The mechanism itself serves to restrain the pin 7 or two pins 7 firmly and securely, when the lock assembly 1 is in its locked position with the pin 7 or two pins 7 being extended.

Another advantage of the mechanism of the present invention is that it can be fitted into sliding doors, sliding windows, benches and other sliding devices with a minimum of alternation to the sliding door, the sliding window, benches and the sliding device so as to replace existing locks. Also, the mechanism of the invention is constructed to minimize the effects of rough usage and abuse of devices when applying locks, with the lock assembly 1 being applied very smoothly, easily and without exertion of any considerable amount of force and simply by push of a finger.

OPERATION

When the lock assembly 1 is locked, the control means 5 is engaged with the one pin 7 or two pins 7 in such a manner that the pin 7 or two pins 7 are engaged with the second sliding member 4. When the control means 5 is pushed manually, the pressure which is exerted upon pushing the control means 5 compresses the spring 9 engaged with the pin 7 or engaged with the two pins 7 which each shifts in away from the transverse hole 8 of the second sliding member 4 in a direction transverse to direction of movement of the control means 5 between a locked position and an unlocked position. When the control means 5 is pushed, each pin 7 shifts inwards and the corresponding spring 9 is further compressed, reserving any bounce back energy. In cases where a pair of second sliding members 4 are used, each pin 7 moves inwards towards and deeper into the control means 5 and out of and away from the end wall 6' of the corresponding second sliding member 4 of the pair of second sliding members 4 when the control means 5 is pushed. As the first section 39 of each cut-out section 21 of the control means 5 moves along the middle portion 35 of the internal portion 31 of the corresponding pin 7, each pin 7 moves into the control means 5 and, thus, into the housing 3 of the lock assembly 1 and away from the end wall 6' of the corresponding second sliding member 4 of the pair of second sliding members 4. In a preferred embodiment, as the middle portions 35 of the internal portions 31 of the pair of pins 7 move into the control means 5, the external portions 27 of the pair of pins 7 enter the housing 3. When the pair of pins 7 unlock, the back portion 37 of the internal portion 31 prevents the escape of the pin 7 through the first section 39 of the cut-out section 21 of the control means 5 and, as a result, prevents the escape of the control means 5 through the housing 3. Meanwhile, shifting of the pin 7 or of the two pins 7 permits the sliding of the cut-out section 21 of the control means 5 along the corresponding number of pins 7 until the pin 7 or the two pins 7 reach the upper edge 43 of the cut-out section 21. As soon as the movement of the pin 7 or of the two pins 7 is stopped, the pin 7 or two pins 7 which are acted on by the second spring 9" assume a position which ensures return to a locked position. As long as the control means 5 is not released, the pin 7 or the two pins 7 remain in an unlocked position. While holding the control means 5 in the unlocked position, one moves the lock assembly 1 to any desired position. As soon as the control means 5 is released, the pin 7 or the two pins 7 immediately and automatically twist or move longitudinally relative to the control means 5 and return to the locked position again. In order to relock the pair of pins 7, the control means 5 is released, such that each pin 7 reaches the bottom edge 65 of the supplemental cut-out section 67 and such that the corresponding spring 9 shifts the corresponding pin 7 away from the control means 5 and toward the end wall 6' of the corresponding second sliding member 4 of the pair of second sliding members 4 (and also toward the corresponding side wall 28" of the first sliding member 2, if the first sliding member 2 has side walls 28" through which the external portion 27 of the pair of pins 7 pass). The spring 9 for each pin 7 pushes behind the corresponding disc 29, causing the pair of pins 7 to return to the locked position again and to thereafter remain in the locked position until the control means is pushed.

The push of the control means 5 is easy and frees the pin 7 or the pair of pins 7. As the user moves the control means 5 forward in the direction indicated by the arrow in FIG. 2A and in FIG. 4, the pin 7 or the two pins 7, which are unlocked, are shifted to open the lock assembly 1. Therefore, a very important aspect of the invention is unlocking of the lock assembly 1 by shifting the control means 5 in a single direction to shift the pin 7 or the two pins 7, a shifting that can be performed simply by push of a finger. The unlocking of the lock assembly 1 is even simpler than the locking of the lock assembly 1 and consists of releasing the lock assembly 1, such that the locking of the lock assembly 1 is automatic.

Certain objects are set forth above and made apparent from the foregoing description, drawings and examples. However, since certain changes may be made in the above description, drawings and examples without departing from the scope of the invention, it is intended that all matters contained in the foregoing description, drawings and examples shall be interpreted as illustrative only of the principles of the invention and not in a limiting sense. With respect to the above description and examples then, it is to be realized that any descriptions, drawings and examples deemed readily apparent and obvious to one skilled in the art and all equivalent relationships to those stated in the examples and described in the specification or illustrated in the drawings are intended to be encompassed by the present invention.

Further, since numerous modifications and changes will readily occur to those skilled in the art, it is not desired to limit the invention to the exact construction and operation shown and described, and accordingly, all suitable modifications and equivalents may be resorted to, falling within the scope of the invention. It is also to be understood that the following claims are intended to cover all of the generic and specific features of the invention herein described, and all statements of the scope of the invention which, as a matter of language, might be said to fall in between.

What is claimed as invention is:

1. A lock assembly comprising:

(a) a housing;

(b) a control means being movably loaded onto the housing;

(c) a pair of pins being held by and supported by the housing, with each pin moving from a locked position to an unlocked position in a direction transverse to a direction of movement of the control means between a locked position and an unlocked position; and (d) a spring for and in contact with each pin;

such that the control means is pushed for starting and enhancing the shifting movement of each pin toward the unlocked position;

such that, upon release of the control means, the spring for each pin is released and enhances shifting of each corresponding pin from the unlocked position back to the locked position and thereafter holds the corresponding pin in the locked position until the control means is pushed again; and such that each pin returns toward the locked position upon release of the control means and upon release of the spring for each pin;

wherein the housing consists of:

i. a first pair of opposite sides with a first pair of openings that lead to a first channel in the housing, ii. a second pair of opposite sides with a second pair of openings that lead to a second channel in the housing that intersects and is transverse to the first channel, and iii. a third pair of opposite sides including a back side;

wherein the control means comprises:

i. a front section, ii. a back section, iii. a top section, iv. a bottom section, v. a pair of opposite side sections, and vi. a cut-out section on the front section, on the back section and on each opposite side section of the control means, whereby a primary channel extends between the front section and the back section and whereby a secondary channel extends between the pair of opposite side sections of the control means;

wherein the pair of pins is supported by the housing and automatically shifts throughout the second pair of openings in a direction transverse to a direction of shift of the control means and between the locked position and the unlocked position, while automatically shifting back to the locked position upon being released;

wherein the spring for each pin is for enhancing the shifting movement of the pin toward the locked position; and wherein said lock assembly further comprises an attaching means connecting the housing to a first sliding member;

such that when the control means is shifted through the first channel from the locked position to the unlocked position and the lock assembly is unlocked, the pair of pins automatically shift inwards via the second channel through the second pair of openings and the first sliding member slides along a pair of second sliding members; and such that when the control means moves through the first pair of opening via the first channel of the housing from the unlocked position to the locked position and the lock assembly is locked, the pair of pins automatically shift out via the second channel of the housing through the second pair of openings.

2. The lock assembly according to claim 1, wherein the first sliding member consists of two side walls, each having a number of transverse holes, and an end wall, with each side wall of the first sliding member extending along the corresponding side of the second pair of opposite sides of the housing, such that the back side and the second pair of opposite sides of the housing are openly embraced by the walls of the first sliding member; and such that the pair of pins shift inwards via the second channel through the second pair of openings and the pair of pins are not locked any more in a pair of transverse holes in the pair of second sliding members, the first sliding member slides along the pair of second sliding members, with each second sliding member having an end wall with transverse holes and two side walls and with each pair of transverse holes being directly opposite to each other, while the housing is secured and locked against twisting or longitudinal movement relative to the first sliding member by any suitable attaching means to be received through holes from the back side of the housing without reaching the first channel or the second channel such that the attaching means contacts neither the pair of pins nor the control means.

3. The lock assembly according to claim 2, wherein the transverse holes of the pair of second sliding members and the number of transverse holes of the first sliding members are spaced circumferentially from the first pair of opposite sides and from the third pair of opposite sides of the housing by an angle of 90° relative to a longitudinal axis of the control means.

4. The lock assembly according to claim 1, wherein each pin comprises:

(a) an external portion;

(b) a disc that is adjacent to and that is of a larger diameter than the external portion; and (c) an internal portion that is of a smaller diameter than the disc and that consists of three sections consisting of:

i. a front portion, ii. a middle portion, and iii. a back portion, with the middle portion being of smallest diameter among the sections of the internal portion.

5. The lock assembly according to claim 4, wherein the second channel, in which the pin is positioned and through which the pin moves while being locked and unlocked, comprises:

(a) an outer section with a back wall; and (b) an inner section that has a diameter that is smaller than a diameter of the outer section and that is slightly larger than a diameter of the back portion of the internal portion of the pin;

such that the front portion of the internal portion of the pin is sufficiently smaller in diameter than the inner section of the second channel to enable the front portion to slide smoothly in the inner section when the pin is locked and unlocked but not small enough to allow the passage of the spring, that is around a portion of the front portion of the internal portion of the pin, that has a diameter that is larger than the diameter of the inner section of the second channel and that, thus, remains in the outer section of the second channel, into the inner section;

such that the disc of the pin has a diameter that is slightly smaller than the diameter of the outer section of the second channel but larger than a diameter of the transverse holes of the end wall of each second sliding member and larger than a diameter of the transverse holes of the side wall of the first sliding member when the first sliding member has side walls through which the external portion of the pair of pins pass, whereby the disc is stopped at the second sliding member when the first sliding member does not have side walls through which the external portion of the pair of pins pass or is stopped at the first sliding member when the first sliding member has side walls through which the external portion of the pair of pins pass;

such that the spring is between the disc and the back wall of the outer section of the second channel; and such that the spring and the disc each have a larger diameter than the inner section of the second channel, whereby the disc is prevented from entering the inner section.

6. The lock assembly according to claim 5, wherein the pin is in the locked position such that:

(a) the external portion of the pin extends out of the outer section of the second channel;

(b) the disc is at the external end of the outer section of the second channel and is adjacent to the corresponding second opposite side of the second pair of opposite sides of the housing;

(c) a portion of the front portion of the internal portion of the pin extends along the outer section of the second channel and any remaining portion of the front portion of and a portion of the middle portion of the internal portion of the pin extend along the inner section of the second channel; and (d) any remaining portion of the middle portion of the pin and the back portion of the pin rest in the cut-out section of the control means.

7. The lock assembly according to claim 5, wherein the spring is longer than the outer section of the second channel, such that when the pin is locked, the spring extends all along the outer section of the second channel, from the back wall of the outer section to the disc at the corresponding second opening of the second pair of openings of the corresponding second opposite side of the second pair of opposite sides, with tension of the spring pushing the pin outwards and keeping the pin in position and keeping the lock assembly constantly locked, unless the spring is pressed farther back between the disc of the pin and the back wall of the outer section of the second channel while the pin is shifting inwards when the control means is being pushed from the locked position to the unlocked position.

8. The lock assembly according to claim 5, wherein the cut-out section of the control means comprises:

(a) a first section that is rectangular and is limited by an upper edge; and (b) a remaining section that is basically circular with a diameter and is limited by a lower edge, with the first section having a width that is smaller than the diameter of the remaining section and that is smaller than the diameter of the back portion of the internal portion of the pin prohibiting exit of the pin via the first section of the cut-out section, while the diameter of the remaining section of the cut-out section is large enough to allow passage of the back portion of the internal portion of the pin;

such that the back portion and the middle portion of each pin each has a diameter that is sufficiently small to allow intrusion of the back portion and of the middle portion into the remaining section, to allow resting of the back portion and of the middle portion within the remaining section of the cut-out section while the pin is in the locked position and while the pin is being in the locked position and moving into the unlocked position and to allow smooth and troubleless movement of the middle portion and of the back portion of the internal portion of the pin through the remaining section;

such that the width of the first section of the cut-out section is sufficiently large to allow smooth and troubleless movement of the middle portion of the internal portion along the first section, but is sufficiently small to prevent exit of the back portion of the internal portion from the first section of the cut-out section; and such that the upper edge and the lower edge of each cut-out section set the limits of movement of each pin.

9. The lock assembly according to claim 8, wherein the width of the first section of the cut-out section of the control means is smaller than the diameter of the back portion of the internal portion of each pin;

such that as the control means is pushed in one direction, a force is exerted by the control means on the back portion of the internal portion of each pin to force the pin to move in an opposite direction;

such that when the control means is pushed in that direction to an extent to create a force that reaches a magnitude sufficient to retrieve the external portion of each pin out of the corresponding transverse hole of the pair of second sliding members, the pair of pins snap into the unlocked position;

such that when the control means is pushed, the pair of pins shift inwards and the corresponding spring is further compressed, reserving any bounce back energy; and such that when the control means is released, so is the spring for each pin, with the spring for each pin pushing behind the corresponding disc and causing the pin to return to the locked position again when the pair of pins are adjacent to a pair of transverse holes of the pair of second sliding member and also adjacent to a corresponding pair of transverse holes of the first sliding member when the first sliding member has a number of transverse holes, whereby the back portion of the internal portion of each pin moves towards the corresponding remaining section of the cut-out section, the middle portion of the internal portion of each pin returns partly into the inner section of the corresponding second channel upon moving partly out of the control means, the front portion of the internal portion of each pin shifts from the inner section of the corresponding second channel toward the outer section of the corresponding second channel, the disc of each pin moves in the outer section of the corresponding second channel to the corresponding second opening of the second pair of openings of the second pair of opposite sides and, finally, the external portion of each pin jumps out into the selected corresponding transverse hole of the corresponding second sliding member of the pair of second sliding members.

10. The lock assembly according to claim 4, wherein the cut-out section of the front section and of the back section serve as supplemental cut-out sections for enhancing smooth and troubleless movement of the pair of pins and wherein each supplemental cut-out section comprises:

(a) a top edge;

(b) a bottom edge; and (c) a pair of opposite slanted sides running in convergence to each other towards the top edge and running in divergence to each other towards the bottom edge;

such that the top edge is shorter than the bottom edge; and such that tangent of slope of the pair of opposite slanted sides of the supplemental cut-out section is equivalent to a locking distance that each pin moves to switch from a locked position to an unlocked position.

11. The lock assembly according to claim 1, wherein each pin comprises:

(a) an external portion;

(b) a disc that is adjacent to and that is of a larger diameter than the external portion and that prevents the pin from extending beyond the external portion into the corresponding second sliding member and into the first sliding member when the first sliding member has side walls through which the external portion of the pair of pins pass; and (c) an internal portion that is of a smaller diameter than the disc and that consists of three sections consisting of:

i. a front portion, ii. a middle portion, and iii. a back portion, with the middle portion being of smallest diameter among the sections of the internal portion;

such that, when the pair of pins are unlocked, the pair of pins are held by and supported by the housing and by the first sliding member when the first sliding member has side walls through which the external portion of the pair of pins pass; and such that, when the pair of pins are locked, the pair of pins are held by and supported by the housing, in conjunction with and simultaneously with the corresponding second sliding member, as well as by the first sliding member when the first sliding member has side walls through which the external portion of the pair of pins pass, while the spring for each pin pushes behind the corresponding disc.

12. A method of operation of a lock assembly, wherein the lock assembly comprises:

(a) a housing;

(b) a control means being movably loaded onto the housing;

(c) a pair of pins being held by and supported by the housing, with each pin moving from a locked position to an unlocked position in a direction transverse to a direction of movement of the control means between a locked position and an unlocked position; and (d) a spring for and in contact with each pin;

such that the control means is pushed for starting and enhancing the shifting movement of each pin toward the unlocked position;

such that, upon release of the control means, the spring for each pin is released and enhances shifting of each corresponding pin from the unlocked position back to the locked position and thereafter holds the corresponding pin in the locked position until the control means is pushed again; and such that each pin returns toward the locked position upon release of the control means and upon release of the spring for each pin;

wherein the housing consists of:

i. a first pair of opposite sides with a first pair of openings that lead to a first channel in the housing, ii. a second pair of opposite sides with a second pair of openings that lead to a second channel in the housing that intersects and is transverse to the first channel, and iii. a third pair of opposite sides including a back side;

wherein the control means comprises:

i. a front section, ii. a back section, iii. a top section, iv. a bottom section, v. a pair of opposite side sections, and vi. a cut-out section on the front section, on the back section and on each opposite side section of the control means, whereby a primary channel extends between the front section and the back section and whereby a secondary channel extends between the pair of opposite side sections of the control means;

wherein the pair of pins is supported by the housing and automatically shifts throughout the second pair of openings in a direction transverse to a direction of shift of the control means and between the locked position and the unlocked position, while automatically shifting back to the locked position upon being released;

wherein the spring for each pin is for enhancing the shifting movement of the pin toward the locked position; and wherein said lock assembly further comprises an attaching means connecting the housing to a first sliding member;

such that when the control means is shifted through the first channel from the locked position to the unlocked position and the lock assembly is unlocked, the pair of pins automatically shift inwards via the second channel through the second pair of openings and the first sliding member slides along a pair of second sliding members; and such that when the control means moves through the first pair of openings via the first channel of the housing from the unlocked position to the locked position and the lock assembly is locked, the pair of pins automatically shift out via the second channel of the housing through the second pair;

said method of operation of the lock assembly comprising:

(a) pushing the control means to move each pin toward the unlocked position; and (b) releasing the control means, such that the spring for each pin is released and shifting of each corresponding pin from the unlocked position back to the locked position is started and is enhanced, with the corresponding pin being held in the locked position until the control means is pushed again.

13. The method of operation of the lock assembly according to claim 12, wherein each pin comprises:

(a) an external portion;

(b) a disc that is adjacent to and that is of a larger diameter than the external portion and that prevents the pin from extending beyond the external portion into the corresponding second sliding member and into the first sliding member if the first sliding member has side walls through which the external portion of the pair of pins pass; and (c) an internal portion that is of a smaller diameter than the disc and that consists of three sections consisting of:
i. a front portion,
ii. a middle portion, and
iii. a back portion, with the middle portion being of smallest diameter among the sections of the internal portion; whereby as the control means returns to its original position:

(a) the back portion of the internal portion of each pin moves towards the corresponding remaining section of the cut-out section;

(b) the middle portion of the internal portion of each pin returns partly into the inner section of the corresponding second channel upon moving partly out of the control means;

(c) the front portion of the internal portion of each pin shifts from the inner section of the corresponding second channel toward the outer section of the corresponding second channel;

(d) the disc of each pin moves in the outer section of the corresponding second channel to the corresponding second opening of the second pair of openings of the second pair of opposite sides; and (e) the external portion of each pin jumps out into the selected corresponding transverse hole of the corresponding second sliding member of the pair of second sliding members.

14. The method of operation of the lock assembly according to claim 12, wherein when pressure is exerted upon each pin, the disc of each pin prohibits the escape of the pin through the corresponding transverse hole of the corresponding second sliding member of the pair of second sliding members, with the disc of each pin being larger in diameter than the corresponding transverse hole of the corresponding second sliding member of the pair of second sliding members.

15. The method of operation of the lock assembly according to claim 12, wherein when pressure is exerted upon each pin, the disc of each pin prohibits the escape of the pin through the corresponding transverse hole of the first sliding member when the first sliding member has a number of transverse holes through which the external portion of the pair of pins pass, with the disc of each pin being larger in diameter than the corresponding transverse hole of the first sliding member, such that application of the lock assembly enables support of the first sliding member at various positions of placement of the lock assembly amidst the pair of second sliding members; and such that the lock assembly is located at vertically spaced positions in general alignment with the selected pair of transverse holes of the pair of second sliding members.

* * * * *